US007050034B2

(12) United States Patent
Uchino et al.

(10) Patent No.: US 7,050,034 B2
(45) Date of Patent: May 23, 2006

(54) DISPLAY APPARATUS

(75) Inventors: Katsuhide Uchino, Kanagawa (JP); Junichi Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 163 days.

(21) Appl. No.: 10/226,659

(22) Filed: Aug. 23, 2002

(65) Prior Publication Data

US 2003/0038795 A1 Feb. 27, 2003

(30) Foreign Application Priority Data

Aug. 24, 2001 (JP) ..... 2001-254800

(51) Int. Cl.
*G09G 3/36* (2006.01)

(52) U.S. Cl. ..... 345/99; 345/100

(58) Field of Classification Search ..... 345/98–100, 345/213, 87, 89, 99, 94
See application file for complete search history.

(56) References Cited

U.S. PATENT DOCUMENTS

| | | | | |
|---|---|---|---|---|
| 5,200,925 | A * | 4/1993 | Morooka | 365/219 |
| 6,448,953 | B1 * | 9/2002 | Murade | 345/98 |
| 6,580,423 | B1 | 6/2003 | Seiko Epson Corp | |
| 6,862,015 | B1 * | 3/2005 | Fujioka et al. | 345/98 |
| 6,894,673 | B1 * | 5/2005 | Koga et al. | 345/99 |
| 2001/0054997 | A1 * | 12/2001 | Fujioka et al. | 345/87 |
| 2002/0149558 | A1 * | 10/2002 | Kashima et al. | 345/100 |
| 2003/0011557 | A1 * | 1/2003 | Koga et al. | 345/99 |
| 2004/0046727 | A1 * | 3/2004 | Fujioka et al. | 345/98 |
| 2005/0018107 | A1 * | 1/2005 | Uamashita et al. | 349/98 |

FOREIGN PATENT DOCUMENTS

JP 2000-081858 3/2000

OTHER PUBLICATIONS

"The D Flip-Flop", 1996, Ken Bigelow.uuhttp://www.play-hookey.com/digital/d_nand_flip-flop.html.*
Zeljco Zilic, "Phase- and Delay-Locked Loop Clock Control in Digital Systems", 1996, TechOnLine.uuhttp://www.techonline.com/community/related_content/14627.*

* cited by examiner

*Primary Examiner*—Amare Mengistu
(74) *Attorney, Agent, or Firm*—Robert J. Depke; Trexler, Bushnell, Giangiorgi, Blackstone & Marr, Ltd.

(57) ABSTRACT

A horizontal driving circuit includes: a shift register for performing shift operation in synchronism with a first clock signal HCK and sequentially outputting a shift pulse from each of shift stages thereof; a first switch group for extracting a second clock signal DCK in response to the shift pulse sequentially outputted from the shift register; and a second switch group for sequentially sampling an input video signal in response to the second clock signal DCK extracted by each switch of the first switch group, and supplying the sampled video signal to each of signal lines. An external clock generating circuit is disposed external to a panel to externally supply the horizontal driving circuit with the first clock signal HCK, and an internal clock generating circuit is disposed within the panel to internally supply the horizontal driving circuit with the second clock signal DCK.

5 Claims, 26 Drawing Sheets

VIDEO SIGNAL video
BLACK LEVEL
BACKGROUND GRAY LEVEL

SAMPLING PULSE

VIDEO SIGNAL video'
BLACK LEVEL
BACKGROUND GRAY LEVEL

DISPLAY APPARATUS

This application claims priority to Japanese Patent Application Number JP2001-254800 filed Aug. 24, 2001, which is incorporated herein by reference.

BACKGROUND OF THE INVENTION

The present invention relates to a display apparatus, and particularly to an active matrix display apparatus of a dot-sequential driving type using a so-called clock driving method in a horizontal driving circuit thereof.

In a display apparatus, for example an active matrix liquid crystal display apparatus using a liquid crystal cell as a display element (electro-optical element) of a pixel, a horizontal driving circuit of a dot-sequential driving type using a clock driving method, for example, is known. FIG. 13 shows a conventional example of the clock driving type horizontal driving circuit. In FIG. 13, the horizontal driving circuit 100 has a shift register 101, a clock extracting switch group 102, and a sampling switch group 103.

The shift register 101 is formed by "n" shift stages (transfer stages). When a horizontal start pulse HST is supplied to the shift register 101, the shift register 101 performs shift operation in synchronism with horizontal clocks HCK and HCKX opposite to each other in phase. Thus, as shown in a timing chart of FIG. 14, the shift stages of the shift register 101 sequentially output shift pulses Vs1 to Vsn having a pulse width equal to a cycle of the horizontal clocks HCK and HCKX. The shift pulses Vs1 to Vsn are supplied to switches 102-1 to **102-*n* of the clock extracting switch group 102**.

The switches 102-1 to **102-*n* of the clock extracting switch group 102 are alternately connected at one terminal thereof to clock lines 104-1 and 104-2 that input the horizontal clocks HCKX and HCK. By being supplied with the shift pulses Vs1 to Vsn from the shift stages of the shift register 101, the switches 102-1 to 102-*n* of the clock extracting switch group 102 are sequentially turned on to alternately extract the horizontal clocks HCKX and HCK. The extracted pulses are supplied as sampling pulses Vh1 to Vhn to switches 103-1 to 103-*n* of the sampling switch group 103**.

The switches 103-1 to **103-*n* of the sampling switch group 103 are each connected at one terminal thereof to a video line 105 for transmitting a video signal "video". The switches 103-1 to 103-*n* of the sampling switch group 103 are sequentially turned on in response to the sampling pulses Vh1 to Vhn extracted and sequentially supplied by the switches 102-1 to 102-*n* of the clock extracting switch group 102, thereby sequentially sample the video signal "video", and then supply the sampled video signal "video" to signal lines 106-1 to 106-*n*** of a pixel array unit (not shown).

In the clock driving type horizontal driving circuit 100 according to the foregoing conventional example, a delay is caused in the sampling pulses Vh1 to Vhn by wiring resistance, parasitic capacitance and the like in a transmission process from the extraction of the horizontal clocks HCKX and HCK by the switches 102-1 to **102-*n* of the clock extracting switch group 102 to the supply of the horizontal clocks HCKX and HCK as the sampling pulses Vh1 to Vhn to the switches 103-1 to 103-*n* of the sampling switch group 103**.

The delay in the sampling pulses Vh1 to Vhn in the transmission process causes waveforms of the sampling pulses Vh1 to Vhn to be rounded. As a result, directing attention to the sampling pulse Vh2 in the second stage, for example, as is particularly clear from a timing chart of FIG. 15, the waveform of the sampling pulse Vh2 in the second stage overlaps the waveforms of the preceding and succeeding sampling pulses Vh1 and Vh3 in the first stage and the third stage.

In general, as shown in FIG. 15, charge and discharge noise is superimposed on the video line 105 at an instant when each of the switches 103-1 to **103-*n* of the sampling switch group 103 is turned on, because of a relation in potential between the video line 105 and the signal lines 106-1 to 106-*n***.

In such a situation, when the sampling pulse Vh2 overlaps the sampling pulses in the preceding and succeeding stages, as described above, charge and discharge noise caused by turning on the sampling switch 103-3 in the third stage is sampled in sampling timing of the second stage based on the sampling pulse Vh2. The sampling switches 103-1 to **103-*n* sample and hold the potential of the video line 105 in timing in which the sampling pulses Vh1** to Vhn reach an "L" level.

In this case, since the charge and discharge noise superimposed on the video line 105 is varied and also the timing in which each of the sampling pulses Vh1 to Vhn reaches the "L" level is varied, the potential sampled by the sampling switches 103-1 to **103-*n*** is varied. As a result, the variation in the sampled potential appears as a vertical streak on the display screen, thus degrading picture quality.

When the number of pixels in a horizontal direction, in particular, is increased with higher definition in the active matrix liquid crystal display apparatus of the dot-sequential driving type, it is difficult to secure a sufficient sampling time for the sequential sampling for all the pixels of the video signal "video" inputted by one system within a limited horizontal effective period. Accordingly, in order to secure a sufficient sampling time, as shown in FIG. 16, a method is used in which video signals are inputted in parallel by "m" systems (m is an integer of 2 or more), and with "m" pixels in the horizontal direction as a unit, "m" sampling switches are provided and driven simultaneously by one sampling pulse, whereby sequential writing in a unit of "m" pixels is performed.

In the following, consideration will be given to a case where a fine black line having a width corresponding to the unit pixel number "m" or less is displayed. When such a black line is displayed, the video signal "video" is inputted as a waveform having a black level portion in the form of a pulse as shown in FIG. 17A, and having a pulse width equal to that of a sampling pulse (B). Although the video signal "video" in the form of the pulse is ideally a rectangular wave, a rising edge and a falling edge of the pulse waveform are rounded (video signal "video'") due to wiring resistance, parasitic capacitance and the like of the video line transmitting the video signal "video", as shown in FIG. 17C.

When the video signal "video'" in the form of the pulse having the rounded rising edge and falling edge is sampled and held by the sampling pulses Vh1 to Vhn, although the video signal "video'" in the form of the pulse is intended to be sampled and held by a sampling pulse Vhk in a kth stage, the rising edge portion of the video signal "video'" is sampled and held by a sampling pulse Vhk−1 in the preceding stage, or the falling edge portion of the video signal "video'" is sampled and held by a sampling pulse Vhk+1 in the succeeding stage. As a result, a ghost occurs. The ghost refers to an undesired interference image displaced from and overlapping the normal image.

A phase relation of the video signal "video'" (hereinafter referred to simply as the video signal "video") with the sampling pulse Vhk can be changed to six phases of S/H=0 to 5, for example, as shown in FIG. 18 by adjusting a position, that is, a sample hold position of the video signal "video" on a time axis by a circuit for processing the video signal "video".

Dependence of occurrence of a ghost on sample hold will be described in the following. First, consideration will be given to a case where S/H=1. FIG. 19 shows a phase relation between the video signal "video" when S/H=1 and the sampling pulses Vhk−1, Vhk, and Vhk+1, and change in signal line potential. When S/H=1, the video signal "video" in the form of the pulse is sampled and held by the sampling pulse Vhk, whereby the black signal is written to the signal line in the kth stage, and a black line is displayed.

However, at the same time, the black signal portion (pulse portion) of the video signal "video" overlaps the sampling pulse Vhk−1 in the (k−1)th stage, and therefore the black signal is also written to the signal line in the (k−1)th stage. Thus, as shown in FIG. 20, a ghost occurs at a position in the (k−1)th stage, that is, in a front direction of horizontal scanning. Similarly, when S/H=0, the black signal portion of the video signal "video" overlaps the sampling pulse Vhk−1 in the (k−1)th stage, and therefore a ghost occurs in the front direction of horizontal scanning.

Next, consideration will be given to a case where S/H=5. FIG. 21 shows a phase relation between the video signal "video" when S/H=5 and the sampling pulses Vhk−1, Vhk, and Vhk+1, and change in signal line potential. When S/H=5, the black video signal overlaps the sampling pulse Vhk+1 in the (k+1) th stage. The black signal is written to the signal line in the (k+1) th stage when the sampling switch is turned on, and thereafter the signal line potential attempts to return to gray level. However, because of a large amount of overlap, the signal line potential does not completely return to the gray level. Thus, as shown in FIG. 22, a ghost occurs in a position in the (k+1) th stage, that is, in a rear direction of horizontal scanning.

Similarly to the case where S/H=5, when S/H=1 to 4, the sampling pulse Vhk+1 in the (k+1) th stage and the black portion of the video signal overlap each other. The black signal is written to the signal line in the (k+1) th stage when the sampling switch is turned on. However, because of smaller amounts of overlap and hence lower black levels written than when S/H=5, the signal line potential can completely return to the gray level. Thus, no ghost occurs.

In the process as described above, a ghost results from overlap between the video signal "video" and a sampling pulse. The number of sample hold positions such as S/H=2, 3, and 4 in which no ghost occurs in the front or rear direction is referred to as a margin for ghosts (hereinafter referred to as a ghost margin).

Thus, it may not be possible to avoid the problem of waveform rounding occurring at the rising edge and the falling edge of the video signal "video" in the form of a pulse due to wiring resistance, parasitic capacitance and the like of the video line, but occurrence of a ghost can be avoided by setting an optimum sample hold position by a circuit part for processing the video signal "video".

However, since waveform rounding occurs at the rising edge and the falling edge of the video signal "video" in the form of a pulse due to wiring resistance, parasitic capacitance and the like of the video line, the pulse waveform portion of the video signal "video" overlaps the sampling pulse in the preceding or succeeding stage. Therefore, the ghost margin is correspondingly limited. In the above example, the ghost margin is three, with S/H=2, 3, and 4.

SUMMARY OF THE INVENTION

The present invention has been made in view of the above problems, and it is accordingly an object of the present invention to provide a display apparatus that can realize perfect non-overlap sampling in horizontal driving by the clock driving method, and which can thereby prevent a vertical streak caused by overlap sampling and increases the ghost margin.

In order to achieve the above object of the present invention, the following means are provided. According to the present invention, there is provided a display apparatus including: a panel having gate lines in a form of rows, signal lines in a form of columns, and pixels arranged in a matrix manner at intersections of the gate lines and the signal lines; a vertical driving circuit connected to the gate lines for sequentially selecting a row of the pixels; a horizontal driving circuit connected to the signal lines for operating on the basis of a clock signal having a predetermined cycle and sequentially writing a video signal to the pixels of the selected row; and clock generating means for generating a first clock signal serving as a basis for the operation of the horizontal driving circuit, and also generating a second clock signal having a same cycle as and having a lower duty ratio than the first clock signal. The horizontal driving circuit includes: a shift register for performing shift operation in synchronism with the first clock signal and sequentially outputting a shift pulse from each of shift stages thereof; a first switch group for extracting the second clock signal in response to the shift pulse sequentially outputted from the shift register; and a second switch group for sequentially sampling the input video signal in response to the second clock signal extracted by each switch of the first switch group, and supplying the sampled video signal to each of the signal lines. The clock generating means is divided into: an external clock generating circuit disposed external to the panel for externally supplying the horizontal driving circuit with the first clock signal; and an internal clock generating circuit formed within the panel for internally supplying the horizontal driving circuit with the second clock signal.

Preferably, the internal clock generating circuit processes the first clock signal supplied from the external clock generating circuit and thereby generates the second clock signal. In this case, the internal clock generating circuit includes a delay circuit for subjecting the first clock signal to delaying processing, and generates the second clock signal using the first clock signal before the delaying processing and the first clock signal after the delaying processing. The delay circuit is formed by an even number of inverters connected in series with each other, for example. Further, the internal clock generating circuit has a NAND circuit for generating the second clock signal by NAND synthesis of the first clock signal before the delaying processing and the first clock signal after the delaying processing.

With the above configuration, each switch of the first switch group sequentially extracts the second clock signal in response to the shift pulse sequentially outputted from the shift register in synchronism with the first clock signal. Thereby, the second clock signal having the lower duty ratio than the first clock signal is supplied as a sampling signal to the second switch group. Then, each switch of the second switch group sequentially samples and holds the input video signal in response to the sampling signal, and supplies the result to a signal line of a pixel unit. In this case, since the duty ratio of the sampling signal is lower than that of the first clock signal, perfect non-overlap sampling can be realized.

In particular, according to the present invention, the clock generating means is divided into the external clock generating circuit and the internal clock generating circuit. The external clock generating circuit supplies the first clock signal, while the internal clock generating circuit generates the second clock signal. Thus, the number of clock signals externally inputted to the panel can be reduced. Terminals and wiring for external connection formed on the panel can be correspondingly simplified. Furthermore, since the external clock generating circuit needs to supply only the first clock signal serving as a basis for the operation of the horizontal driving circuit, a general-purpose system board that has been used conventionally may be connected as it is to the panel.

BRIEF DESCRIPTION OF THE DRAWINGS

These and other objects of the invention will be seen by reference to the description, taken in connection with the accompanying drawings, in which.

DETAILED DESCRIPTION OF THE PREFERRED EMBODIMENT

Figure 1:
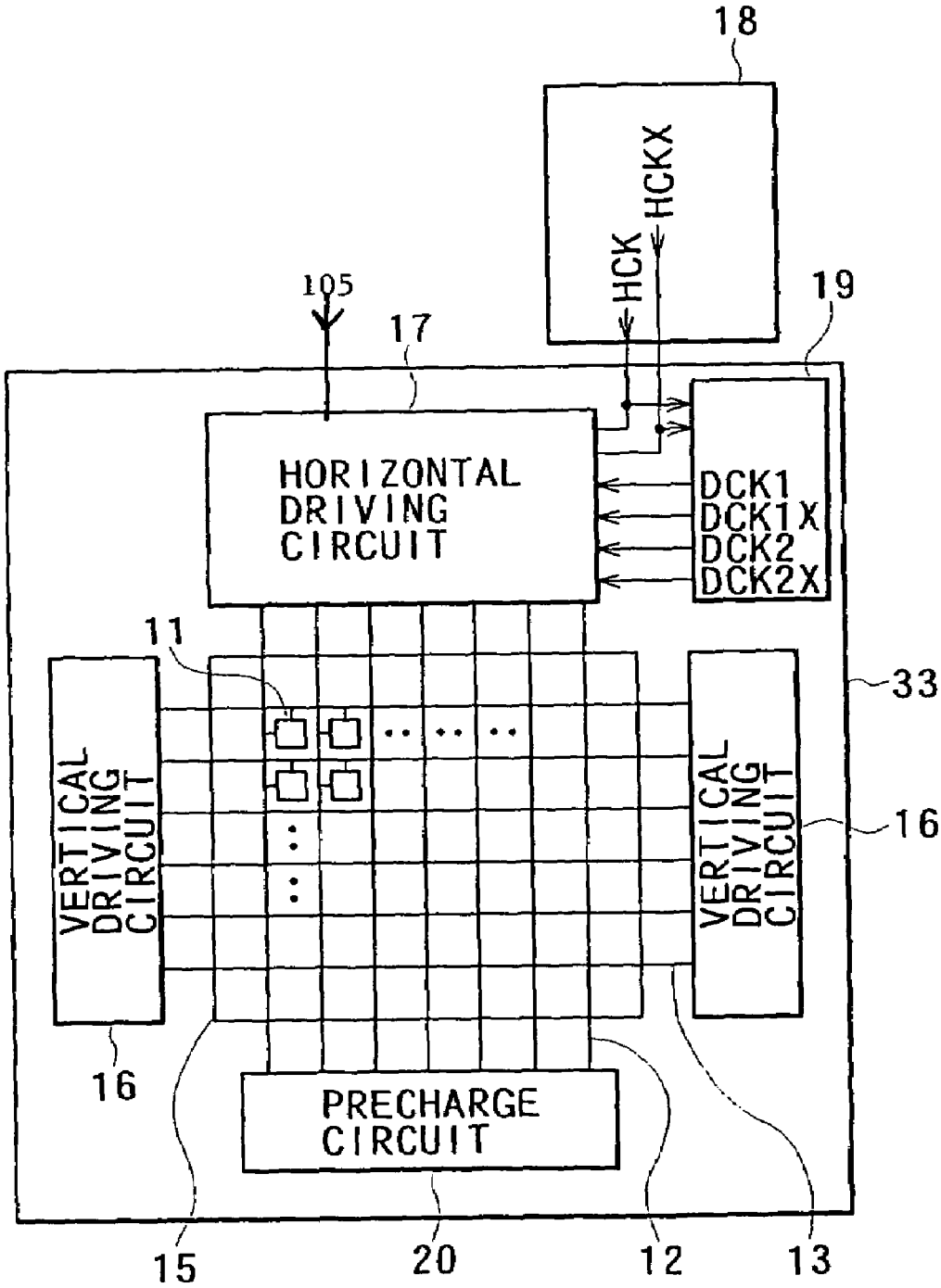
FIG. 1 is a block diagram showing a basic configuration of a display apparatus according to the present invention.

A preferred embodiment of the present invention will hereinafter be described in detail with reference to the drawings. FIG. 1 is a schematic block diagram showing a basic configuration of a display apparatus according to the present invention. As shown in FIG. 1, the display apparatus is formed by a panel 33 having a pixel array unit 15, a vertical driving circuit 16, a horizontal driving circuit 17 and the like formed therein in an integrated manner. The pixel array unit 15 is formed by gate lines 13 in the form of rows, signal lines 12 in the form of columns, and pixels 11 arranged in a matrix manner at intersections of the gate lines 13 and the signal lines 12. The vertical driving circuit 16 is divided into circuits disposed on the left and right sides, which circuits are connected to both ends of the gate lines 13 to sequentially select a row of the pixels 11. The horizontal driving circuit 17 is connected to the signal lines 12. The horizontal driving circuit 17 operates on the basis of a clock signal having a predetermined cycle to sequentially write a video signal to the pixels 11 of the selected row. The display apparatus further includes clock generating means. The clock generating means generates first clock signals HCK and HCKX serving as the basis for the operation of the horizontal driving circuit 17, and also generates second clock signals DCK1, DCK1X, DCK2, and DCK2X having the same cycle as and having a lower duty ratio than the first clock signals HCK and HCKX. HCKX denotes an inverted signal of HCK. Similarly, DCK1X denotes an inverted signal of DCK1, and DCK2X denotes an inverted signal of DCK2.

As a characteristic point of the present invention, the horizontal driving circuit 17 has a shift register, a first switch group, and a second switch group. The shift register performs shift operation in synchronism with the first clock signals HCK and HCKX to sequentially output a shift pulse from each of shift stages thereof. The first switch group extracts the second clock signals DCK1, DCK1X, DCK2, and DCK2X in response to the shift pulses sequentially outputted from the shift register. The second switch group sequentially samples a video signal externally inputted thereto in response to the second clock signals DCK1, DCKLX, DCK2, and DCK2X, and then supplies the result to each of the signal lines 12. Such a configuration can realize perfect non-overlap sampling.

As another characteristic point of the present invention, the clock generating means is divided into an external clock generating circuit 18 and an internal clock generating circuit 19. The external clock generating circuit 18 is disposed on a driving system board external to the panel 33. The external clock generating circuit 18 externally supplies the internal horizontal driving circuit 17 with the first clock signals HCK and HCKX. On the other hand, the internal clock generating circuit 19 is formed within the panel 33 together with the vertical driving circuit 16 and the horizontal driving circuit 17. The internal clock generating circuit 19 generates the second clock signals DCK1, DCK1X, DCK2, and DCK2X within the panel 33, and then supplies the second clock signals DCK1, DCK1X, DCK2, and DCK2X to the horizontal driving circuit 17. In the present embodiment, the internal clock generating circuit 19 processes the first clock signals HCK and HCKX supplied from the external clock generating circuit 18 and thereby generates the second clock signals DCK1, DCK1X, DCK2, and DCK2X.

Figure 2:
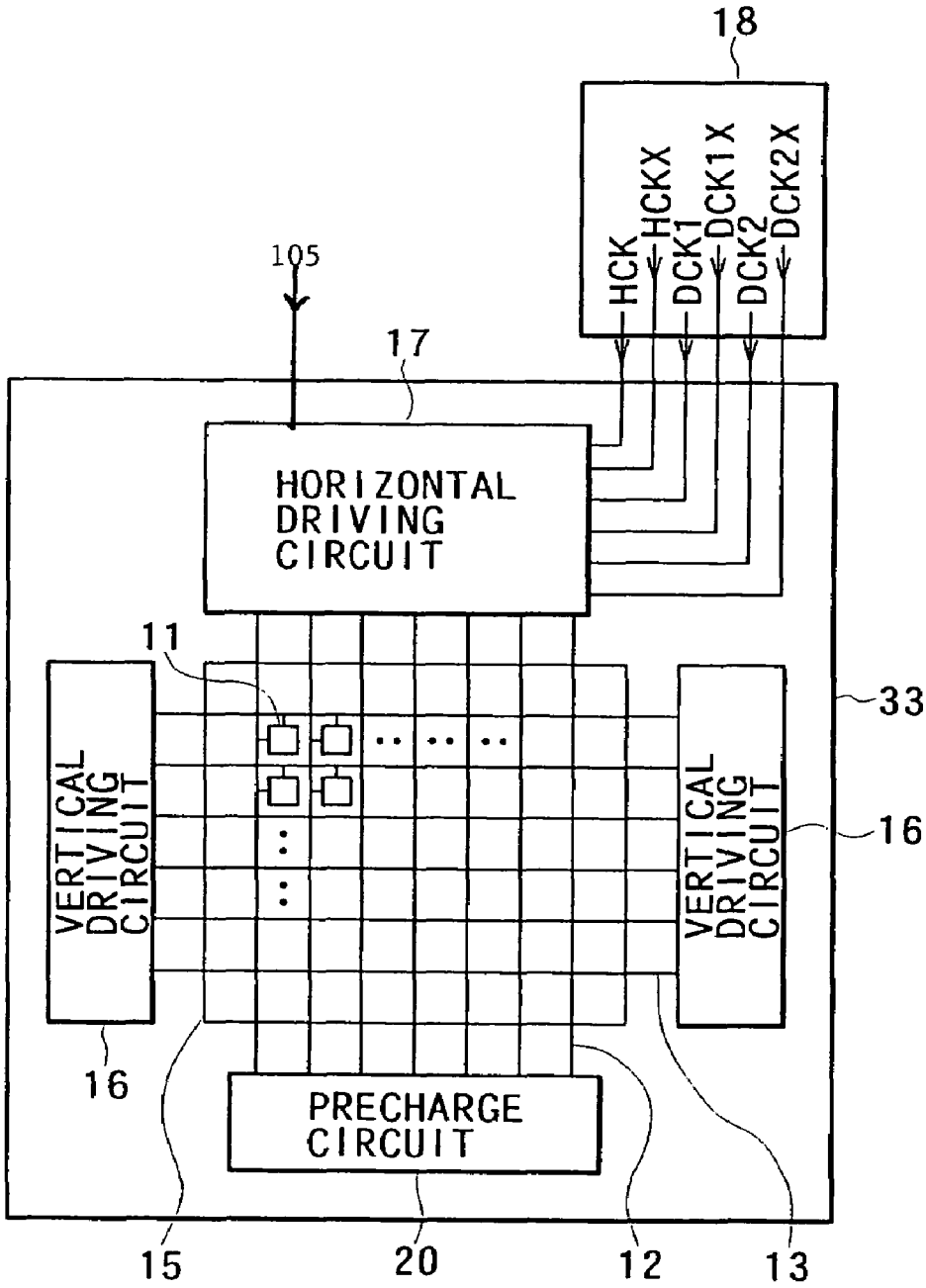
FIG. 2 is a schematic block diagram showing a reference example of a display apparatus.

FIG. 2 is a schematic block diagram showing a reference example of a display apparatus. For comparison with the display apparatus according to the present invention, parts corresponding to those in FIG. 1 are identified by corresponding references. The display apparatus shown in FIG. 2 is different from the display apparatus according to the present invention shown in FIG. 1 in that the first clock signals HCK and HCKX and the second clock signals DCK1, DCK1X, DCK2, and DCK2X are all supplied from an external clock generating circuit 18, and in that a panel 33 has no internal clock generating circuit. The reference example shown in FIG. 2 requires at least six terminals and related wiring for connection of the external clock generating circuit 18 with the panel 33. On the other hand, the display apparatus according to the present invention shown in FIG. 1 requires only two terminals for the external connection.

In general, an external system board is used to drive the panel 33, and supplies various clock signals and a video signal necessary for the panel 33. A general-purpose system board that has been used conventionally has a function of supplying clock signals HCK and HCKX to the panel. An ordinary horizontal driving circuit can be driven by the clock signals HCK and HCKX, and therefore the system board has been conventionally designed to supply the clock signals HCK and HCKX. On the other hand, the present invention adds clock signals DCK1, DCKLX, DCK2, and DCK2X having a pulse width different from that of the clock signals HCK and HCKX to drive the horizontal driving circuit 17. In this case, the configuration shown in FIG. 2 requires that all of the first clock signals and the second clock signals be supplied from the system board, and therefore the system board needs to be redesigned so as to be adapted for the panel according to the present invention, thus increasing cost of the display apparatus as a whole. On the other hand, with the configuration of the present invention shown in FIG. 1, the external clock generating circuit 18 that generates the first clock signals HCK and HCKX remains on the system board, while the internal clock generating circuit 19 that generates the second clock signals is included in the panel 33. As a result, a conventional general-purpose system board can be used as it is to drive the display apparatus according to the present invention shown in FIG. 1. Of course, the number of terminals and wirings for connecting the panel 33 with the system board is unchanged.

Figure 3A:
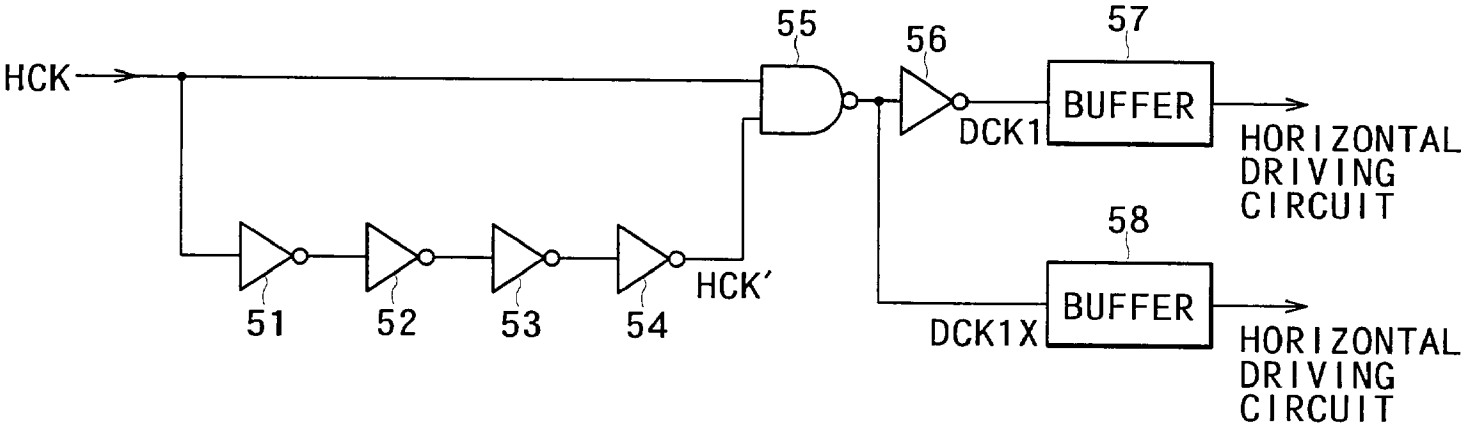
FIGS. 3A and 3B are block diagrams showing a concrete configuration example of an internal clock generating circuit incorporated in the display apparatus shown in FIG. 1.
Figure 3B:
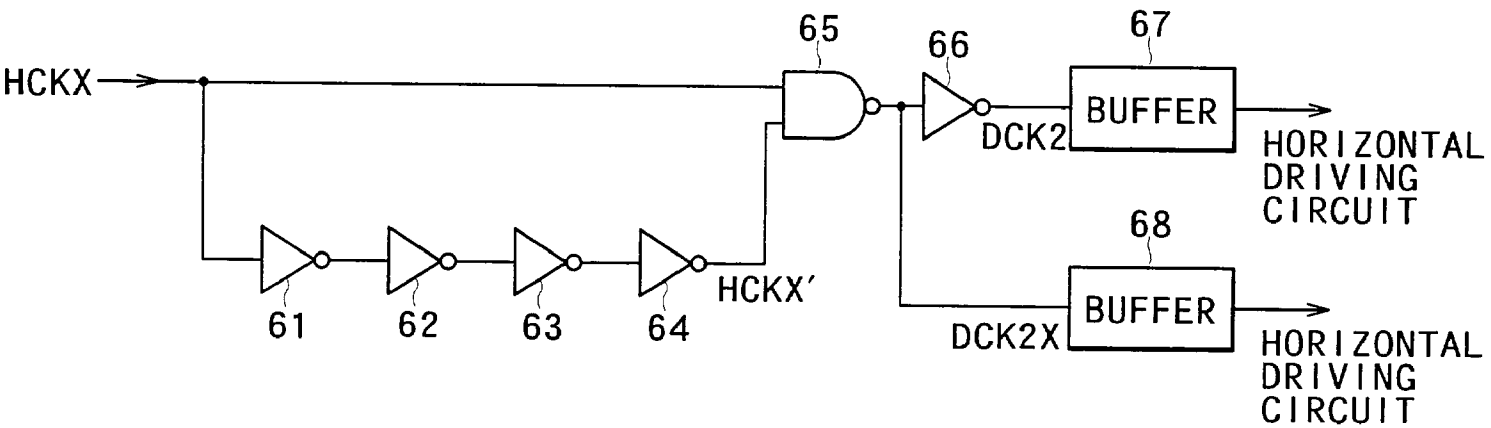

FIGS. 3A and 3B are block diagrams showing a concrete configuration example of the internal clock generating circuit 19 shown in FIG. 1. The internal clock generating circuit is divided into a system of FIG. 3A and a system of FIG. 3B. The two systems basically have the same configuration. The first system of FIG. 3A generates the second clock signals DCK1 and DCK1X on the basis of the first clock signal HCK. The second system of FIG. 3B similarly processes the first clock signal HCKX to thereby generate the second clock signals DCK2 and DCK2X. The first system of FIG. 3A includes: four inverters 51 to 54 connected in series with each other; a NAND circuit 55; an output inverter 56; and two buffers 57 and 58. Similarly, the second system of FIG. 3B includes: four inverters 61 to 64; a NAND circuit 65; an output inverter 66; and a pair of output buffers 67 and 68.

Directing attention to the first system of FIG. 3A, the first clock signal HCK supplied from the external clock generating circuit is divided into two signals. One signal is supplied as it is to one input terminal of the NAND circuit 55. The other signal is supplied to a delay circuit formed by the four inverters 51 to 54 connected in series with each other. An output of the delay circuit is supplied to another input terminal of the NAND circuit 55. Thus, the undelayed signal HCK and the delayed signal HCK' are subjected to NAND synthesis by the NAND circuit 55. A signal outputted from the NAND circuit 55 is inverted by the inverter 56, and then outputted as the clock signal DCK1 via the buffer 57. The signal outputted from an output terminal of the NAND circuit 55 is supplied as the clock signal DCK1X from a branch point to the horizontal driving circuit side via the buffer 58. A pulse signal is commonly known to be delayed each time the pulse signal is passed through an inverter. Thus, in this example, the clock signal HCK' that has been passed through a plurality of inverters is delayed by a few ten nsec with respect to the clock signal HCK that is not passed through inverters. By NAND synthesis of the two clock signals HCK and HCK', the intended clock signals DCK1 and DCK1X can be generated. The clock signals DCK2 and DCK2X are similarly generated by the system of FIG. 3B.

Figure 4A:
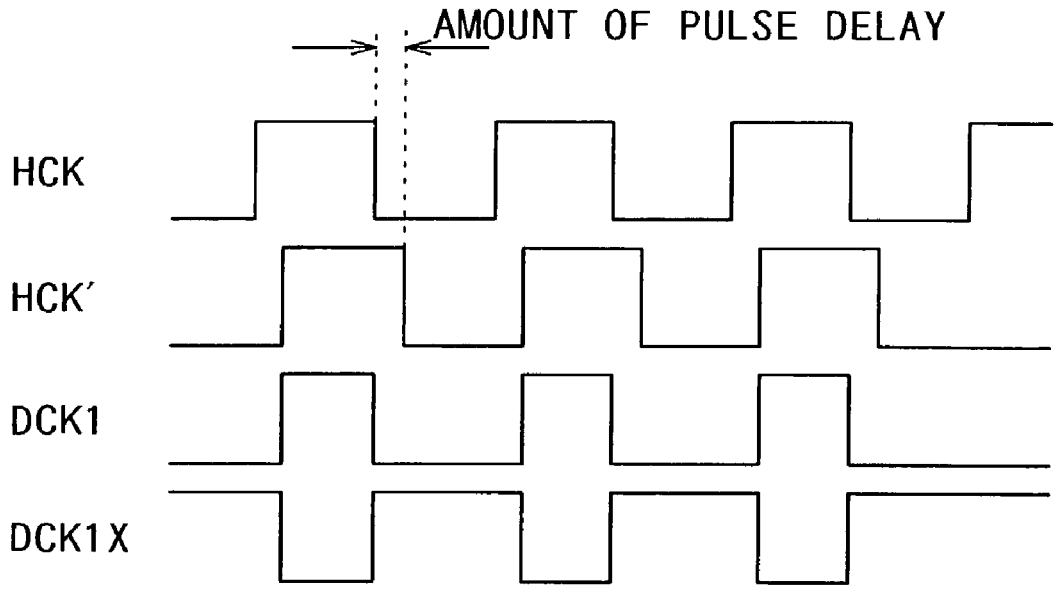
FIGS. 4A and 4B are timing charts of assistance in explaining operation of the internal clock generating circuit shown in FIGS. 3A and 3B.
Figure 4B:
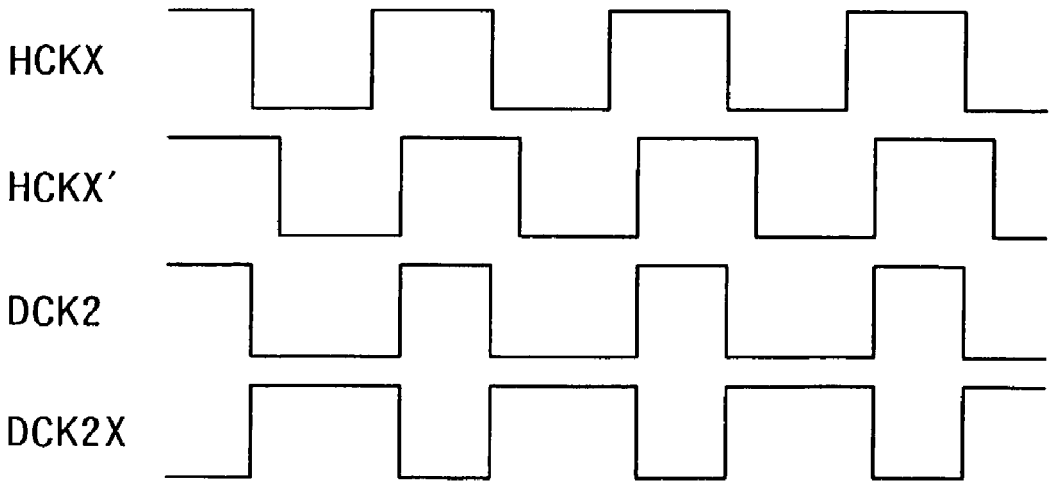

FIGS. 4A and 4B are waveform charts of assistance in explaining operation of the internal clock generating circuit shown in FIGS. 3A and 3B. FIG. 4A shows operation of the first system shown in FIG. 3A, while FIG. 4B shows operation of the second system shown in FIG. 3B. Directing attention to in FIG. 4A, the clock signal HCK' is delayed by a predetermined time with respect to the clock signal HCK. The amount of delay can be set optimally by the number of inverters connected in series with each other. The clock signals HCK and HCK' displaced from each other in phase by the delay processing are subjected to the NAND processing, whereby the clock signal DCK1X is obtained. When the clock signal DCK1X is subjected to inversion processing by the output inverter, the clock signal DCK1 is obtained. Similarly, as shown in FIG. 4B, the undelayed clock signal HCKX and a delayed clock signal HCKX' are subjected to the logical processing to provide the clock signal DCK2X. When the clock signal DCK2X is subjected to inversion processing, the clock signal DCK2 is obtained.

Figure 23A:
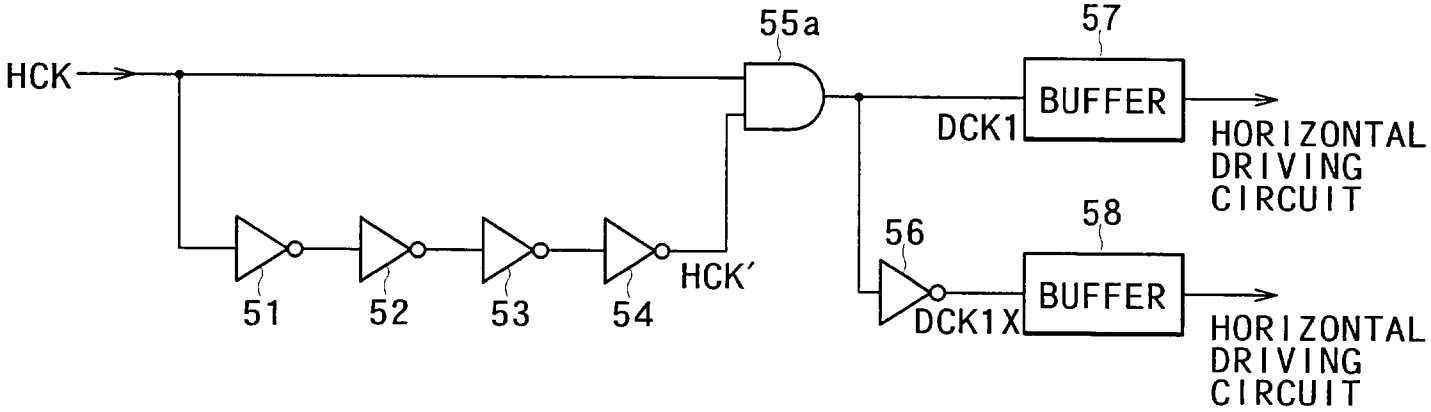
FIGS. 23A and 23B are block diagrams showing another configuration example of the internal clock generating circuit incorporated in the display apparatus shown in FIG. 1.
Figure 23B:
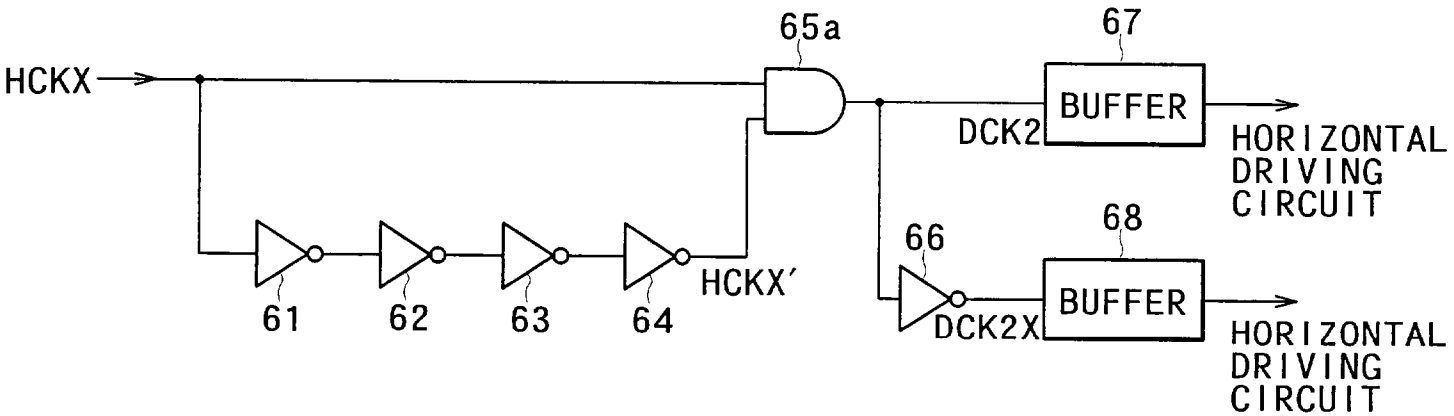

FIGS. 23A and 23B are block diagrams showing another configuration example of the internal clock generating circuit 19 shown in FIG. 1. In order to facilitate understanding, parts corresponding to those of the foregoing configuration example shown in FIGS. 3A and 3B are identified by corresponding references. The configuration example shown in FIGS. 23A and 23B is different from the configuration example shown in FIGS. 3A and 3B in that in a system of the internal clock generating circuit of FIG. 23A, an AND circuit 55*a* is used in place of the NAND circuit 55 and an output inverter 56 is connected on a buffer 58 side. In this example, AND synthesis is used instead of NAND synthesis. An output of the AND circuit 55*a* is the clock signal DCK1, and the output of the AND circuit 55*a* is inverted by the inverter 56 to provide the clock signal DCK1X. Similarly, in a system of the internal clock generating circuit of FIG. 23B, an AND circuit 65*a* is used in place of the NAND circuit 65 and an output inverter 66 is connected on a buffer 68 side.

Figure 24A:
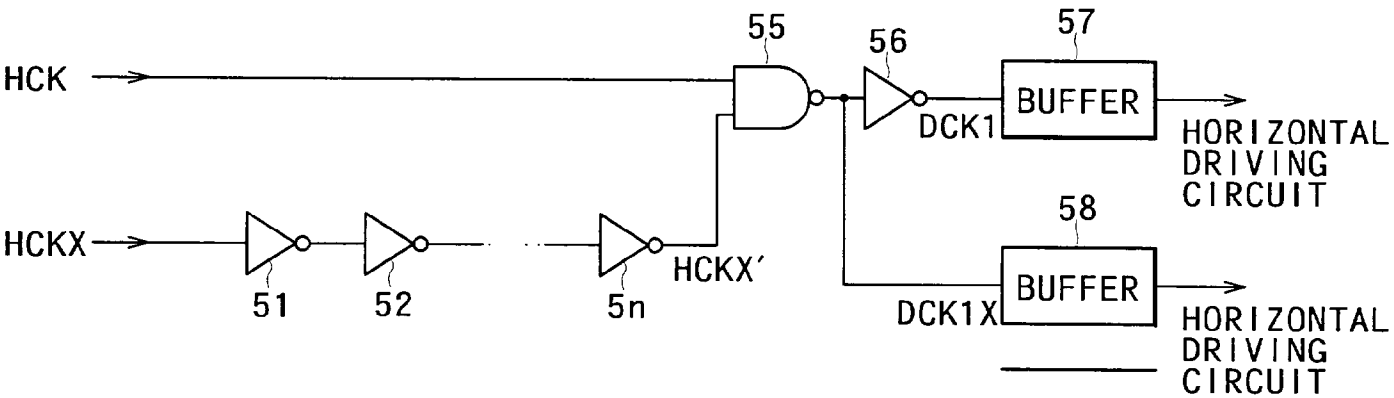
FIGS. 24A and 24B are block diagrams showing another configuration example of the internal clock generating circuit incorporated in the display apparatus shown in FIG. 1.
Figure 24B:
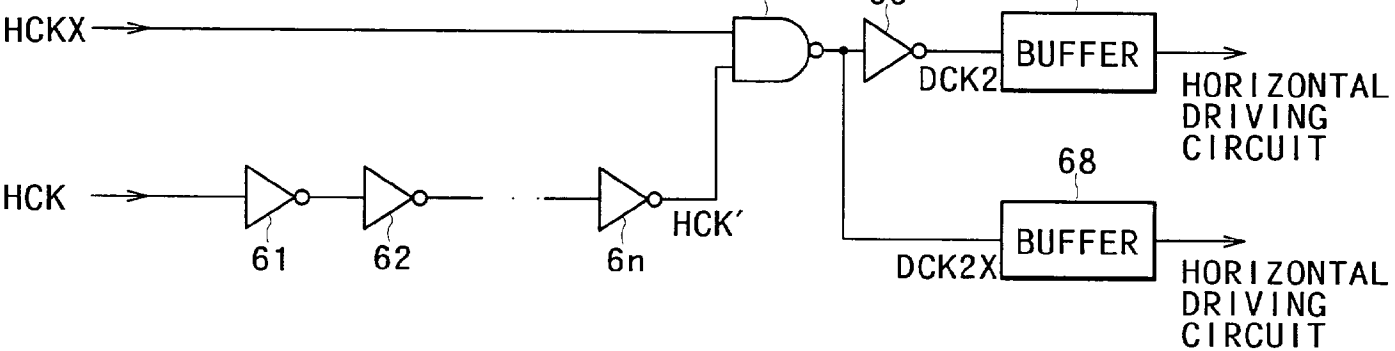
Figure 25:
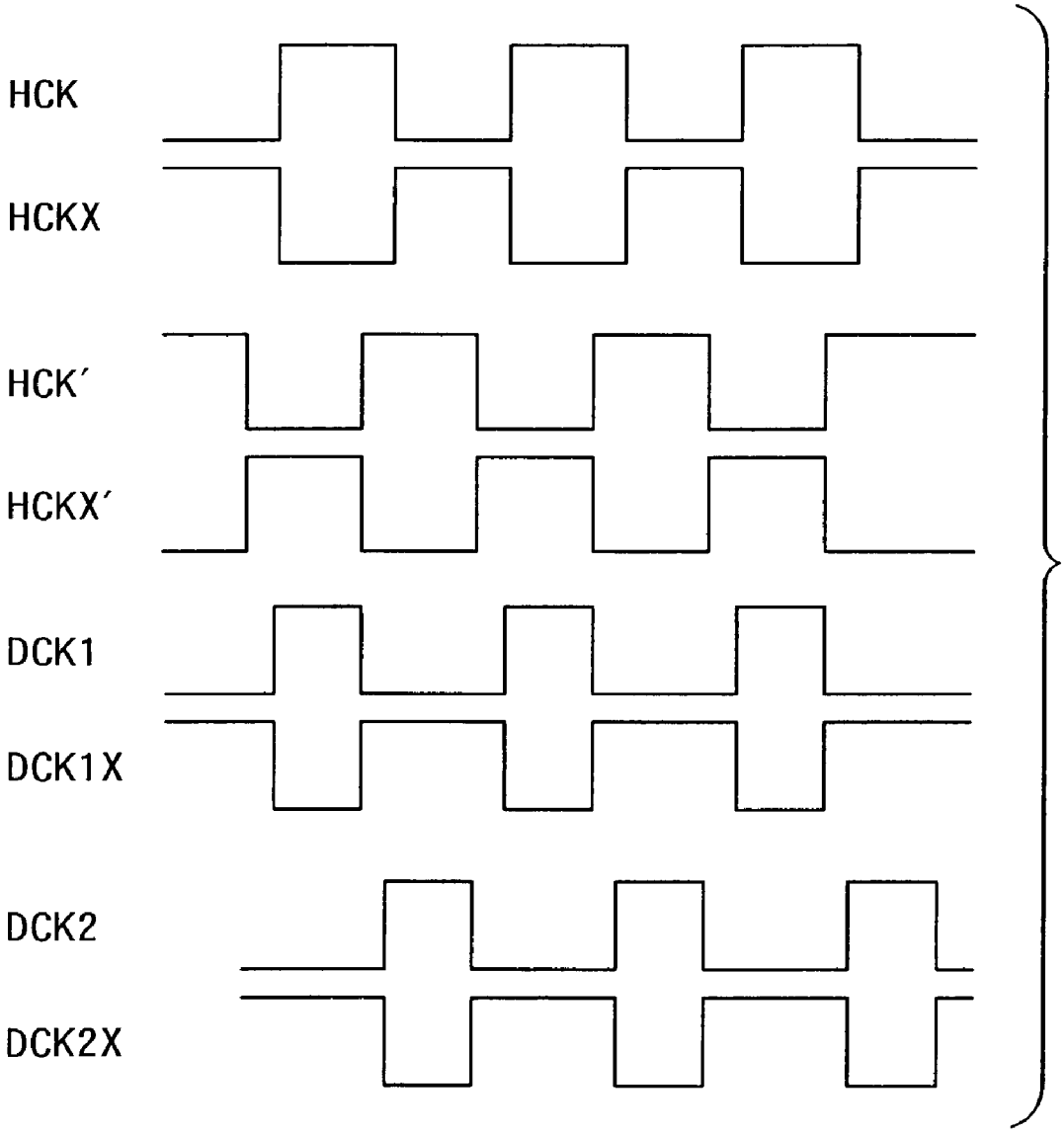
FIG. 25 is a timing chart of assistance in explaining operation of the internal clock generating circuit shown in FIGS. 24A and 24B.

FIGS. 24A and 24B are block diagrams showing another configuration example of the internal clock generating circuit 19 shown in FIG. 1. In order to facilitate understanding, parts corresponding to those of the foregoing configuration example shown in FIGS. 3A and 3B are identified by corresponding references. The configuration example shown in FIGS. 24A and 24B is different from the configuration example shown in FIGS. 3A and 3B in that in a system of the internal clock generating circuit of FIG. 24A, the clock signal HCK and a clock signal HCKX' obtained by delaying the clock signal HCKX are subjected to NAND processing to provide the clock signal DCK1 and the clock signal DCK1X. In addition, the amount of delay of the clock signal HCKX' with respect to the clock signal HCK can be set appropriately by connecting a plurality of delaying inverters 51 to 5*n* (n is an even number). Similarly, in a system of the internal clock generating circuit of FIG. 24B, the clock signal HCKX and a clock signal HCK' obtained by delaying the clock signal HCK are subjected to NAND processing to provide the clock signal DCK2 and the clock signal DCK2X. Operation of the internal clock generating circuit shown in FIGS. 24A and 24B is shown in a waveform chart of FIG. 25.

Figure 26A:
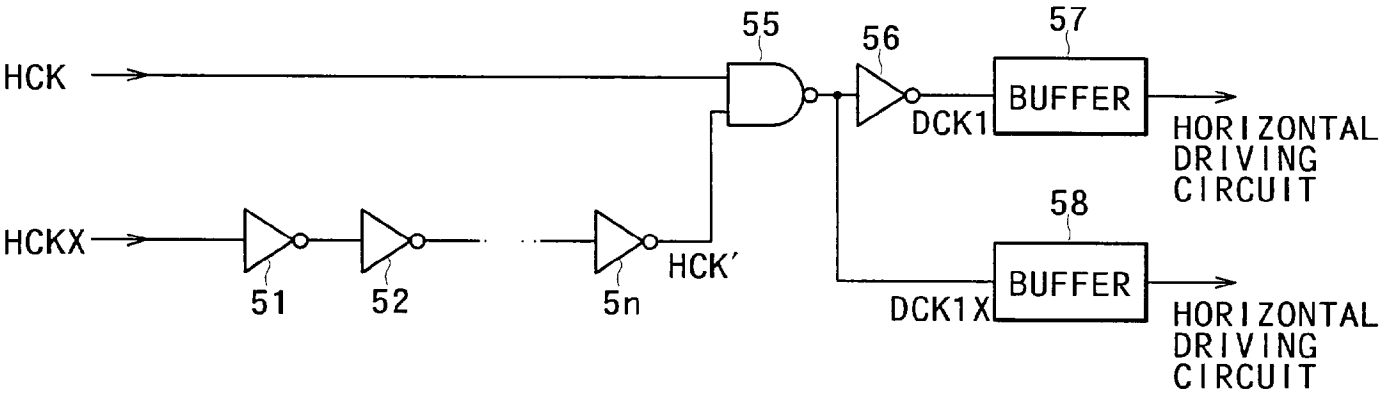
FIGS. 26A are 26B are block diagrams showing yet another configuration example of the internal clock generating circuit incorporated in the display apparatus shown in FIG. 1.
Figure 26B:
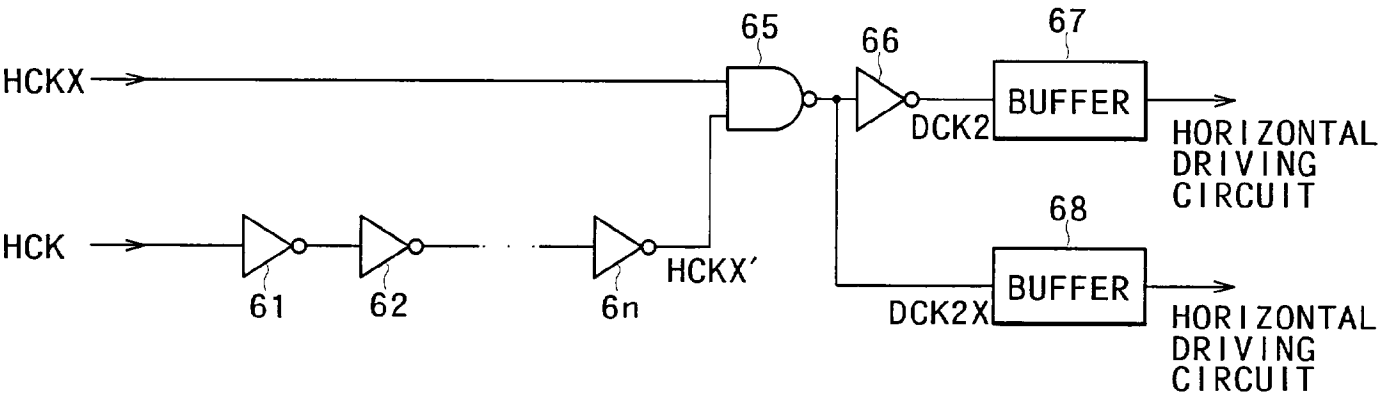

FIGS. 26A and 26B are block diagrams showing another configuration example of the internal clock generating circuit 19 shown in FIG. 1. In order to facilitate understanding, parts corresponding to those of the foregoing configuration example shown in FIGS. 3A and 3B are identified by corresponding references. The configuration example shown in FIGS. 26A and 26B is different from the configuration example shown in FIGS. 3A and 3B in that in a system of the internal clock generating circuit of FIG. 26A, the clock signal HCK and a clock signal HCK' obtained by delaying the clock signal HCKX are subjected to NAND processing to provide the clock signal DCK1 and the clock signal DCK1X. In addition, the amount of delay of the clock signal HCK' with respect to the clock signal HCK is set appropriately by connecting delaying inverters 51 to 5*n* (n is an odd number) in series with each other. Similarly, in a system of the internal clock generating circuit of FIG. 26B, the clock signal HCKX and a clock signal HCKX' obtained by delaying the clock signal HCK are subjected to NAND processing to provide the clock signal DCK2 and the clock signal DCK2X. An operation waveform chart of the internal clock generating circuit shown in FIGS. 26A and 26B is the same as FIGS. 4A and 4B.

Figure 5:
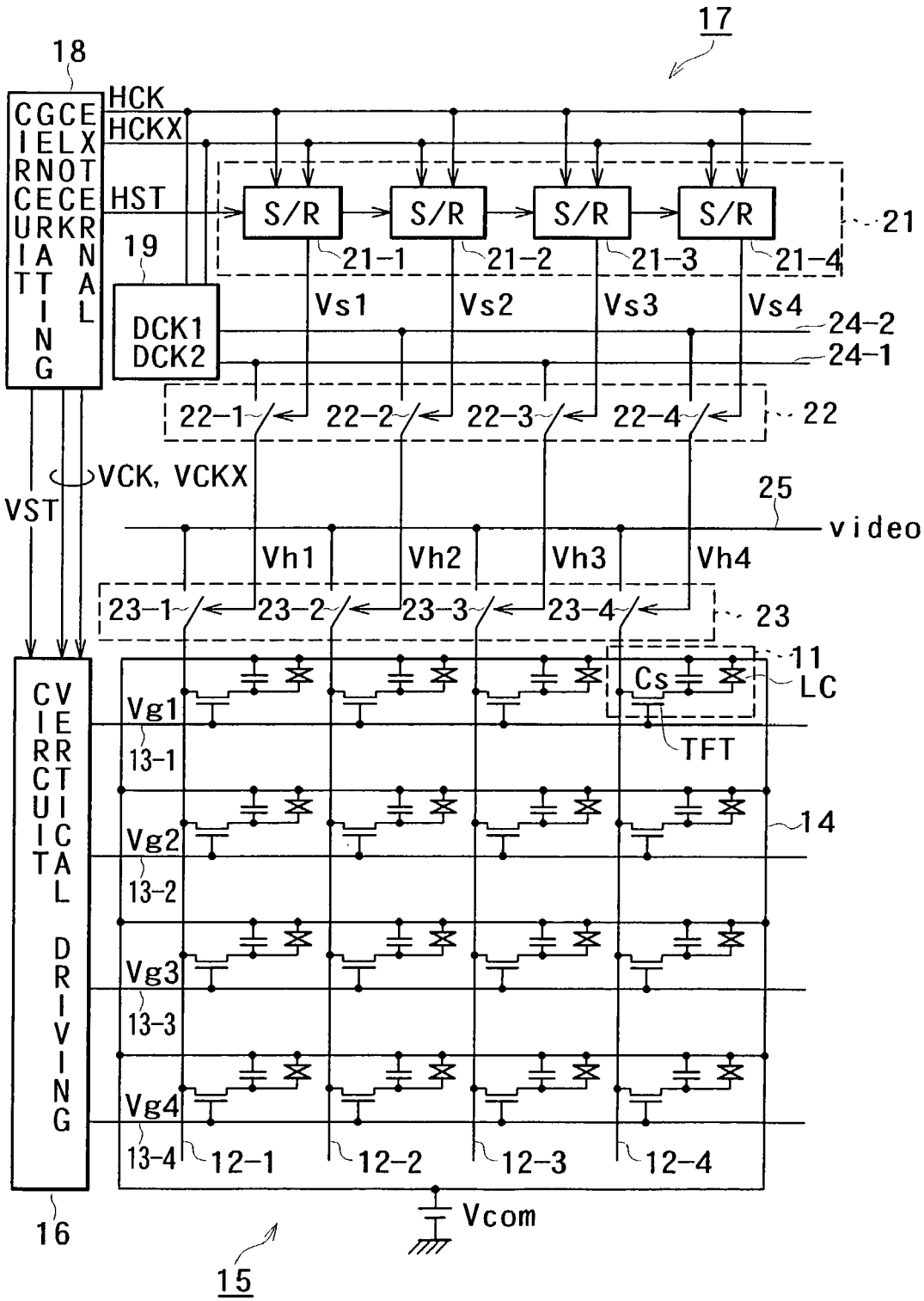
FIG. 5 is a circuit diagram showing a configuration example of an active matrix liquid crystal display apparatus of a dot-sequential driving type according to an embodiment of the present invention.

FIG. 5 is a circuit diagram showing a configuration example of an active matrix liquid crystal display apparatus of a dot-sequential driving type according to an embodiment of the present invention, which apparatus uses a liquid crystal cell as a display element (electro-optical element) of a pixel, for example. In this case, for simplicity of the figure, a pixel arrangement of four rows and four columns is taken as an example. The active matrix liquid crystal display apparatus generally uses a thin film transistor (TFT) as a switching element of each pixel.

In FIG. 5, each of pixels 11 arranged in a matrix manner and corresponding to four rows×four columns includes: a thin film transistor TFT, or a pixel transistor; a liquid crystal cell LC having a pixel electrode connected to a drain electrode of the thin film transistor TFT; and a retaining capacitance Cs having one electrode connected to the drain electrode of the thin film transistor TFT. The pixels 11 are connected to signal lines 12-1 to 12-4 arranged one for each of the columns along a pixel arrangement direction of the columns, while the pixels 11 are connected to gate lines 13-1 to 13-4 arranged one for each of the rows along a pixel arrangement direction of the rows.

A source electrode (or drain electrode) of the thin film transistor TFT in each of the pixels 11 is connected to a corresponding one of the signal lines 12-1 to 12-4. A gate electrode of the thin film transistor TFT is connected to one of the gate lines 13-1 to 13-4. A counter electrode of the liquid crystal cell LC and another electrode of the retaining capacitance Cs are connected to a Cs line 14 common among the pixels. The Cs line 14 is supplied with a predetermined direct-current voltage as a common voltage "Vcom".

Thus, a pixel array unit 15 is formed in which the pixels 11 are arranged in a matrix manner, and the pixels 11 are connected to the signal lines 12-1 to 12-4 arranged one for each of the columns and the gate lines 13-1 to 13-4 arranged one for each of the rows. One end of each of the gate lines 13-1 to 13-4 in the pixel array unit 15 is connected to an output terminal for each of the rows of a vertical driving circuit 16 disposed on a left side of the pixel array unit 15, for example.

The vertical driving circuit 16 scans in a vertical direction (row direction) in each field period to sequentially select the pixels 11 connected to the gate lines 13-1 to 13-4 in row units. Specifically, when the vertical driving circuit 16 supplies a scanning pulse Vg1 to the gate line 13-1, a pixel at the first row in each of the columns is selected. When the vertical driving circuit 16 supplies a scanning pulse Vg2 to the gate line 13-2, a pixel at the second row in each of the columns is selected. Thereafter, scanning pulses Vg3 and Vg4 are similarly supplied to the gate lines 13-3 and 13-4, respectively.

A horizontal driving circuit 17 is disposed on an upper side of the pixel array unit 15, for example. Also, an external clock generating circuit (timing generator) 18 for supplying various clock signals to the vertical driving circuit 16 and the horizontal driving circuit 17 is provided. The external clock generating circuit 18 generates a vertical start pulse VST for giving an instruction to start vertical scanning, vertical clocks VCK and VCKX opposite to each other in phase that clocks serve as reference for vertical scanning, a horizontal start pulse HST for giving an instruction to start horizontal scanning, and horizontal clocks HCK and HCKX opposite to each other in phase that clocks serve as reference for horizontal scanning.

Figure 6:
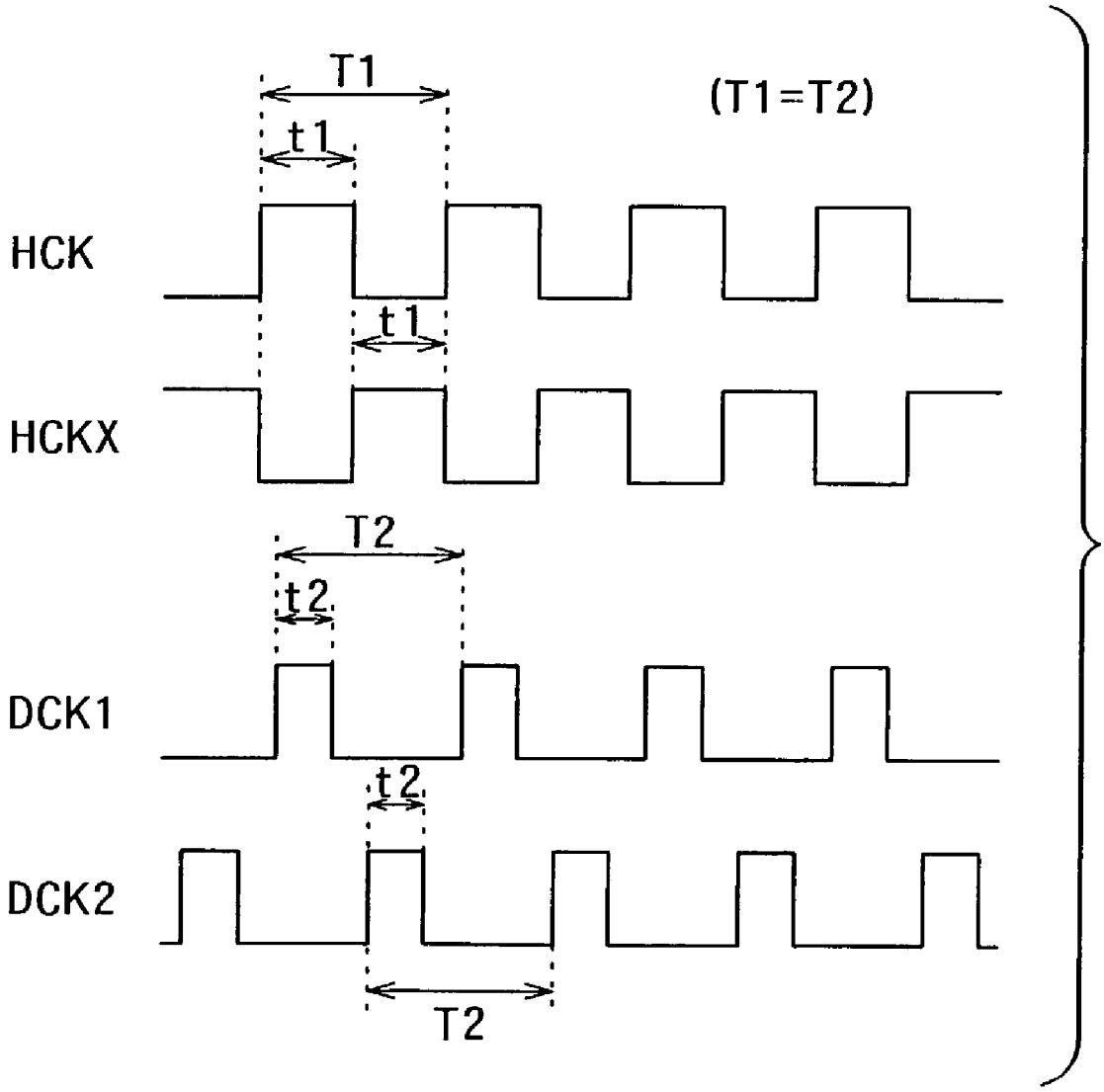
FIG. 6 is a timing chart showing a timing relation between horizontal clocks HCK and HCKX and clocks DCK1 and DCK2.

An internal clock generating circuit 19 is provided separately from the external clock generating circuit 18. As shown in a timing chart of FIG. 6, the internal clock generating circuit 19 generates a pair of clocks DCK1 and DCK2 having the same cycle (T1=T2) as and having a lower duty ratio than the horizontal clocks HCK and HCKX. The duty ratio is a ratio of a pulse width "t" to a pulse cycle period "T" in a pulse waveform.

In this example, the duty ratio (t1/T1) of the horizontal clocks HCK and HCKX is 50%, and the duty ratio (t2/T2) of the clocks DCK1 and DCK2 is lower than the duty ratio of 50%. That is, the pulse width t2 of the clocks DCK1 and DCK2 is set narrower than the pulse width t1 of the horizontal clocks HCK and HCKX.

The horizontal driving circuit 17 is provided to sequentially sample an input video signal "video" in each H (H is a horizontal scanning period) and write the video signal to each of pixels 11 in a unit of a row selected by the vertical driving circuit 16. In this example, the horizontal driving circuit 17 uses a clock driving method. The horizontal driving circuit 17 includes a shift register 21, a clock extracting switch group 22, and a sampling switch group 23.

Figure 7:
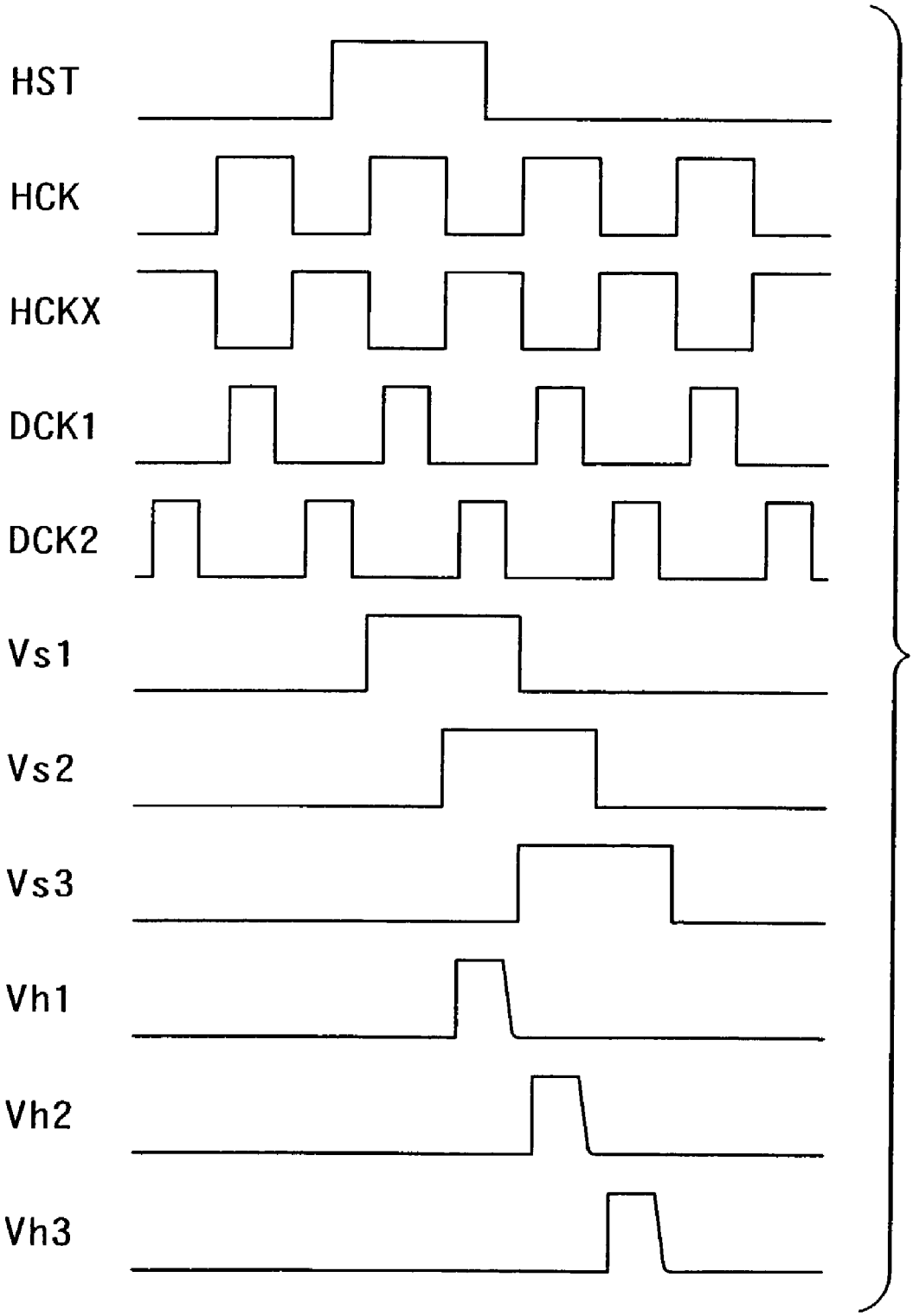
FIG. 7 is a timing chart of assistance in explaining operation of a clock driving type horizontal driving circuit according to the embodiment.

The shift register 21 is formed by four shift stages (S/R stages) 21-1 to 21-4 corresponding to the pixel columns (four columns in this example) of the pixel array unit 15. When the horizontal start pulse HST is supplied to the shift register 21, the shift register 21 performs shift operation in synchronism with the horizontal clocks HCK and HCKX opposite to each other in phase. Thus, as shown in a timing chart of FIG. 7, the shift stages 21-1 to 21-4 of the shift register 21 sequentially output shift pulses Vs1 to Vs4 having a pulse width equal to a cycle of the horizontal clocks HCK and HCKX.

The clock extracting switch group 22 is formed of four switches 22-1 to 22-4 corresponding to the pixel columns of the pixel array unit 15. The switches 22-1 to 22-4 are alternately connected at one terminal thereof to clock lines 24-1 and 24-2 that transmit the clocks DCK2 and DCK1 from the internal clock generating circuit 19. Specifically, the switches 22-1 and 22-3 are connected at one terminal thereof to the clock line 24-1, and the switches 22-2 and 22-4 are connected at one terminal thereof to the clock line 24-2.

The switches 22-1 to 22-4 of the clock extracting switch group 22 are supplied with the shift pulses Vs1 to Vs4 sequentially outputted from the shift stages 21-1 to 21-4 of the shift register 21. When supplied with the shift pulses Vs1 to Vs4 from the shift stages 21-1 to 21-4 of the shift register 21, the switches 22-1 to 22-4 of the clock extracting switch group 22 are sequentially turned on in response to the shift pulses Vs1 to Vs4 to alternately extract the clocks DCK2 and DCK1 opposite to each other in phase.

The sampling switch group 23 is formed of four switches 23-1 to 23-4 corresponding to the pixel columns of the pixel array unit 15. The switches 23-1 to 23-4 are connected at one terminal thereof to a video line 25 for inputting the video signal "video". The clocks DCK2 and DCK1 extracted by the switches 22-1 to 22-4 of the clock extracting switch group 22 are supplied as sampling pulses Vh1 to Vh4 to the switches 23-1 to 23-4 of the sampling switch group 23.

When supplied with the sampling pulses Vh1 to Vh4 from the switches 22-1 to 22-4 of the clock extracting switch group 22, the switches 23-1 to 23-4 of the sampling switch group 23 are sequentially turned on in response to the sampling pulses Vh1 to Vh4 to sequentially sample the video signal "video" inputted through the video line 25. The switches 23-1 to 23-4 of the sampling switch group 23 then supply the sampled video signal "video" to the signal lines 12-1 to 12-4 of the pixel array unit 15.

The thus formed horizontal driving circuit 17 according to the present embodiment alternately extracts the pair of clocks DCK2 and DCK1 in synchronism with the shift pulses Vs1 to Vs4 and directly uses the clocks DCK2 and DCK1 as the sampling pulses Vh1 to Vh4, rather than using the shift pulses Vs1 to Vs4 sequentially outputted from the shift register 21 as the sampling pulses Vh1 to Vh4. Thus, variations in the sampling pulses Vh1 to Vh4 can be reduced. As a result, a ghost caused by variations in the sampling pulses Vh1 to Vh4 can be eliminated.

In addition, rather than extracting the horizontal clocks HCKX and HCK serving as a basis for shift operation of the shift register 21 and using the horizontal clocks HCKX and HCK as the sampling pulses Vh1 to Vh4 as in the conventional technique, the horizontal driving circuit 17 according to the present embodiment separately generates the clocks DCK2 and DCK1 having the same cycle as and having a lower duty ratio than the horizontal clocks HCKX and HCK, and extracts the clocks DCK2 and DCK1 to use as the sampling pulses Vh1 to Vh4. Thus, the following effects can be obtained.

Figure 8:
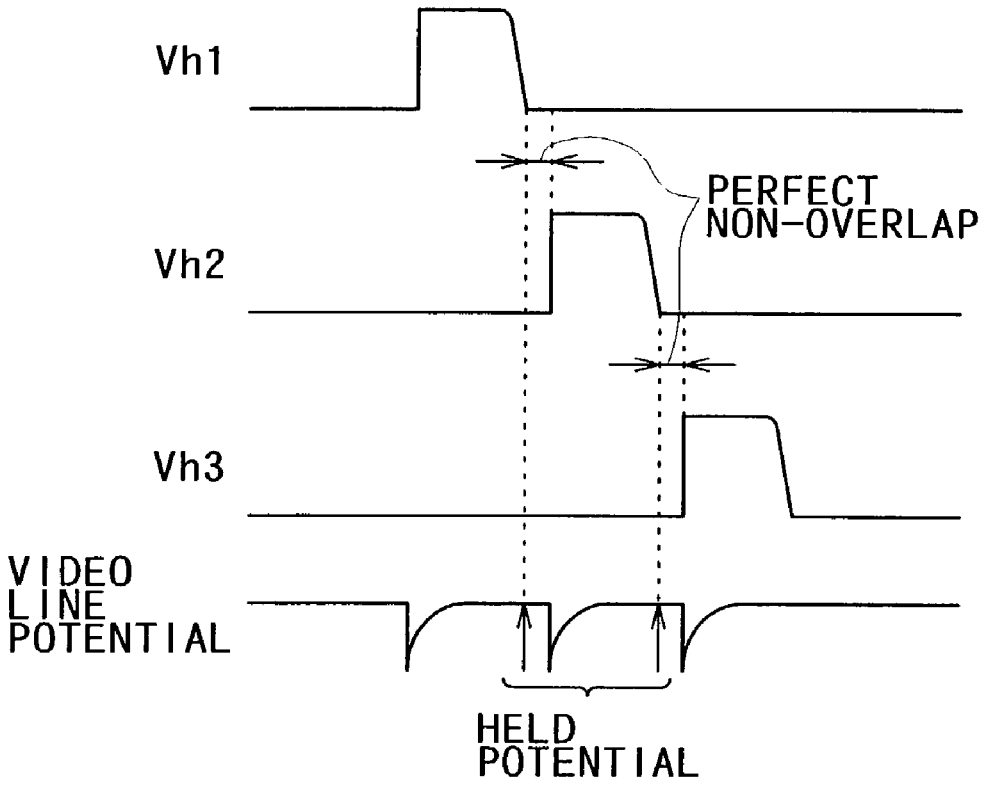
FIG. 8 is a timing chart of video signal sampling operation of the clock driving type horizontal driving circuit according to the embodiment.

As is particularly clear from a timing chart of FIG. 8, even when a delay is caused in the clocks DCK2 and DCK1 by wiring resistance, parasitic capacitance and the like and thereby waveforms of the clocks DCK2 and DCK1 are rounded in a transmission process from the extraction of the clocks DCK2 and DCK1 by the switches 22-1 to 22-4 of the clock extracting switch group 22 to the supply of the clocks DCK2 and DCK1 to the switches 23-1 to 23-4 of the sampling switch group 23, each of the extracted clocks DCK2 and DCK1 has a waveform in a perfectly non-overlapping relation with the preceding and succeeding pulses.

The clocks DCK2 and DCK1 having the perfectly non-overlapping waveform are used as the sampling pulses Vh1 to Vh4. Directing attention to a kth stage in the sampling switch group 23, the sampling of the video signal "video" by the sampling switch in the kth stage can be completed before the turning on of the sampling switch in a (k+1) th stage without fail.

Thus, even when charge and discharge noise is superimposed on the video line 25 at an instant of the turning on of each of the switches 23-1 to 23-4 of the sampling switch group 23, sampling in that stage is performed without fail before charge and discharge noise is caused by switching in the next stage, as shown in FIG. 8. It is therefore possible to prevent sampling of the charge and discharge noise. As a result, in horizontal driving, perfect non-overlap sampling can be realized between the sampling pulses, and hence occurrence of a vertical streak due to overlap sampling can be prevented.

Figure 9:
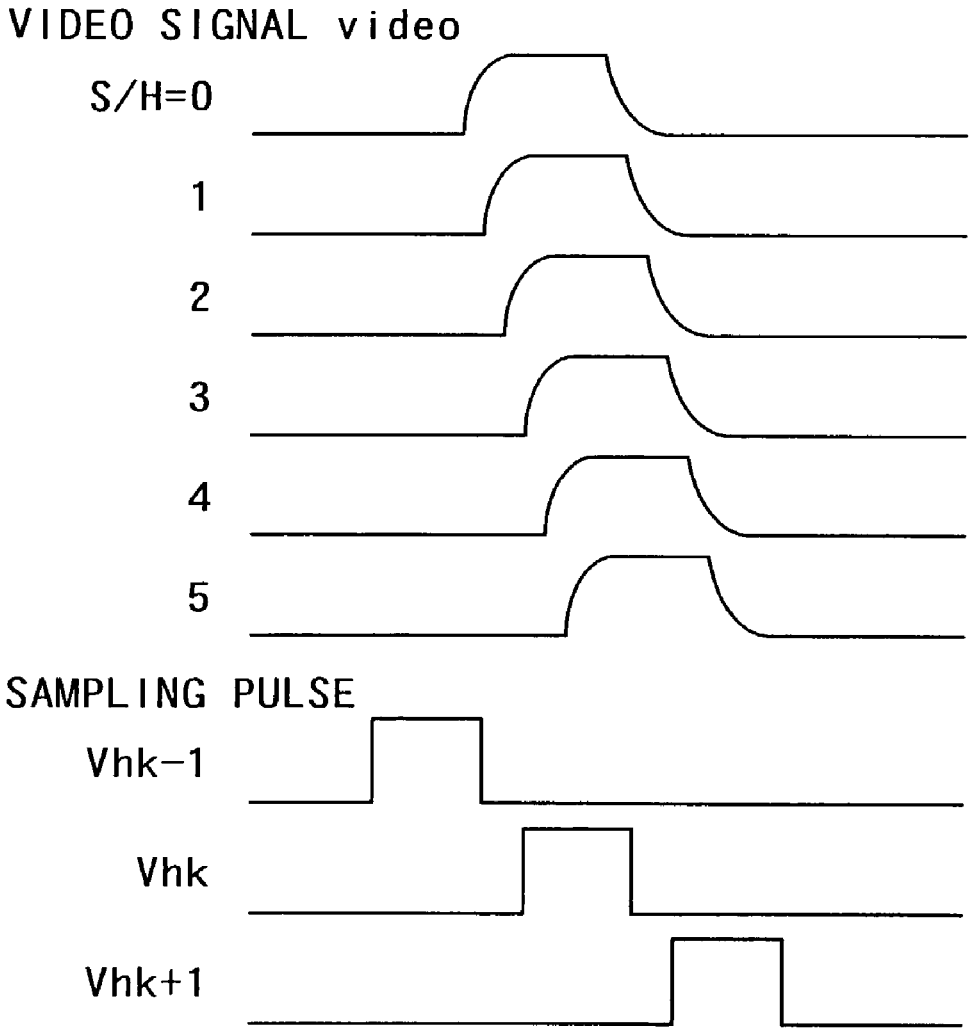
FIG. 9 is a timing chart showing a phase relation between a video signal "video" taking sample hold positions S/H=0 to 5 and perfect non-overlap sampling pulses Vhk−1, Vhk, and Vhk+1.

Furthermore, since perfect non-overlap sampling can be realized, a ghost margin in which no ghost occurs can be set larger than the conventional margin. This will be described in detail in the following. FIG. 9 shows a phase relation between the video signal "video" taking sample hold positions S/H=0 to 5 and perfect non-overlap sampling pulses Vhk−1, Vhk, and Vhk+1, for example.

Figure 10:
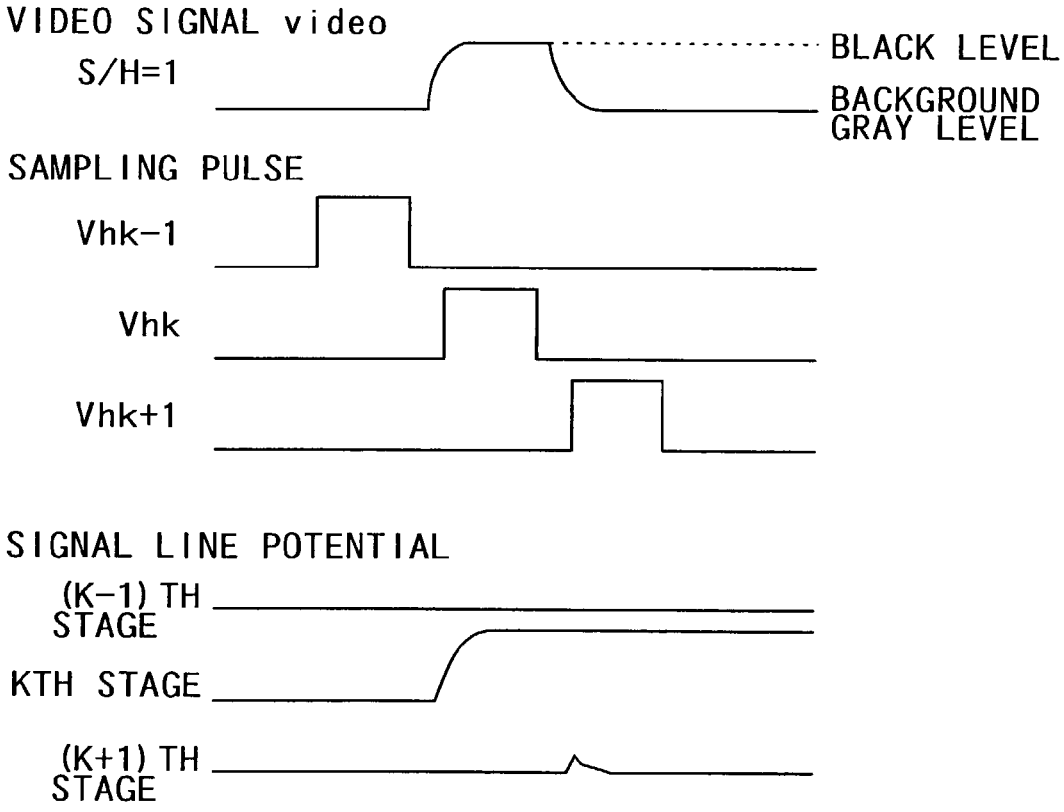
FIG. 10 is a timing chart showing a phase relation between the video signal "video" when S/H=1 and the perfect non-overlap sampling pulses Vhk−1, Vhk, and Vhk+1, and change in signal line potential.

First, consideration will be given to a case where S/H=1. FIG. 10 shows a phase relation between the video signal "video" when S/H=1 and the perfect non-overlap sampling pulses Vhk−1, Vhk, and Vhk+1, and change in signal line potential. When S/H=1, the sampling pulse Vhk−1 in the (k−1)th stage does not overlap a black signal portion (pulse portion) of the video signal "video". Thus, when the video signal "video" in the form of the pulse is sampled by the sampling pulse Vhk, the black signal is written only to the signal line in the kth stage. Therefore, no ghost occurs in a front direction of horizontal scanning.

Figure 11:
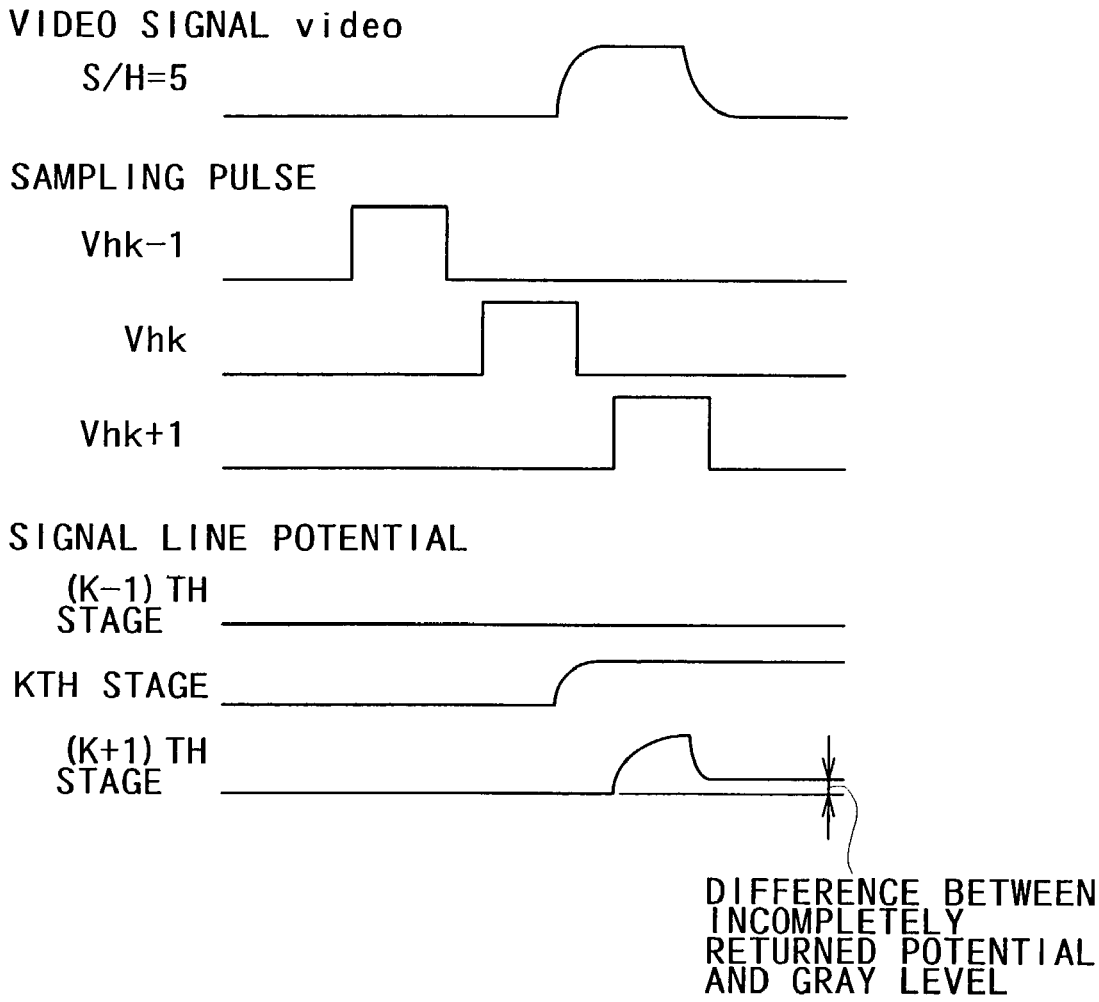
FIG. 11 is a timing chart showing a phase relation between the video signal "video" when S/H=5 and the perfect non-overlap sampling pulses Vhk−1, Vhk, and Vhk+1, and change in signal line potential.

Next, consideration will be given to a case where S/H=5. FIG. 11 shows a phase relation between the video signal "video" when S/H=5 and the sampling pulses Vhk−1, Vhk, and Vhk+1, and change in signal line potential. When S/H=5, the black video signal overlaps the sampling pulse Vhk+1 in the (k+1) th stage. The black signal is written to the signal line in the (k+1) th stage when the sampling switch is turned on, and thereafter the signal line potential attempts to return to gray level. However, because of a large amount of overlap, the signal line potential does not completely return to the gray level. Thus, a ghost occurs in a rear direction of horizontal scanning.

Similarly to the case where S/H=5, when S/H=1 to 4, the sampling pulse Vhk+1 in the (k+1) th stage and the black portion of the video signal overlap each other. The black signal is written to the signal line in the (k+1)th stage when the sampling switch is turned on. However, because of smaller amounts of overlap and hence lower black levels written than when S/H=5, the signal line potential can completely return to the gray level. Thus, no ghost occurs in the rear direction of horizontal scanning.

As compared with the conventional technique in which the sampling pulses Vhk−1, Vhk, and Vhk+1 overlap each other, resulting in overlap sampling, the ghost margin of the conventional technique is three, with S/H=2, 3, and 4, whereas the ghost margin of the present perfect non-overlap sampling method is five in total, with S/H=2, 3, and 4 and additionally S/H=0 and 1. It is therefore possible to increase the ghost margin.

It is to be noted that the foregoing embodiment has been described by taking a case where the present invention is applied to a liquid crystal display apparatus having an analog interface driving circuit that receives an analog video signal as an input, samples the analog video signal, and drives each pixel on a dot-sequential basis; however, the present invention is similarly applicable to a liquid crystal display apparatus having a digital interface driving circuit that receives a digital video signal as an input, latches the digital video signal, then converts the digital video signal into an analog video signal, samples the analog video signal, and drives each pixel on the dot-sequential basis.

Also, while the foregoing embodiment has been described by taking as an example a case where the present invention is applied to an active matrix liquid crystal display apparatus using a liquid crystal cell as a display element (electro-optical element) of each pixel, the present invention is not limited to application to liquid crystal display apparatus. The present invention is applicable to active matrix display apparatus of a dot-sequential driving type in general, which apparatus use the clock driving method in the horizontal driving circuit, such as an active matrix EL display apparatus using an electroluminescence (EL) element as a display element of each pixel.

Dot-sequential driving methods include for example a one H inversion driving method and a dot inversion driving method that are well known, as well as a so-called dot line inversion driving method in which video signals opposite from each other in polarity are simultaneously written to pixels in two rows apart from each other by an odd number of rows, for example two vertically adjacent rows between pixel columns adjacent to each other so that pixels horizontally adjacent to each other are of the same polarity and pixels vertically adjacent to each other are of opposite polarity in pixel arrangement after the writing of the video signals.

Figure 12:
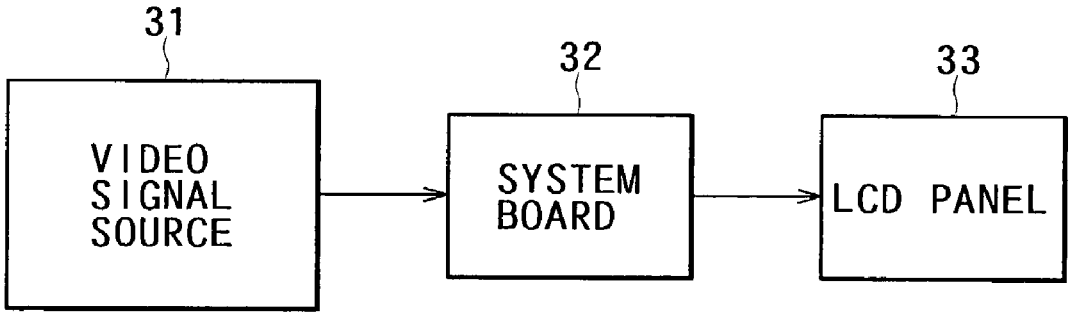
FIG. 12 is a block diagram showing a system configuration of a display apparatus according to the present invention.
Figure 13:
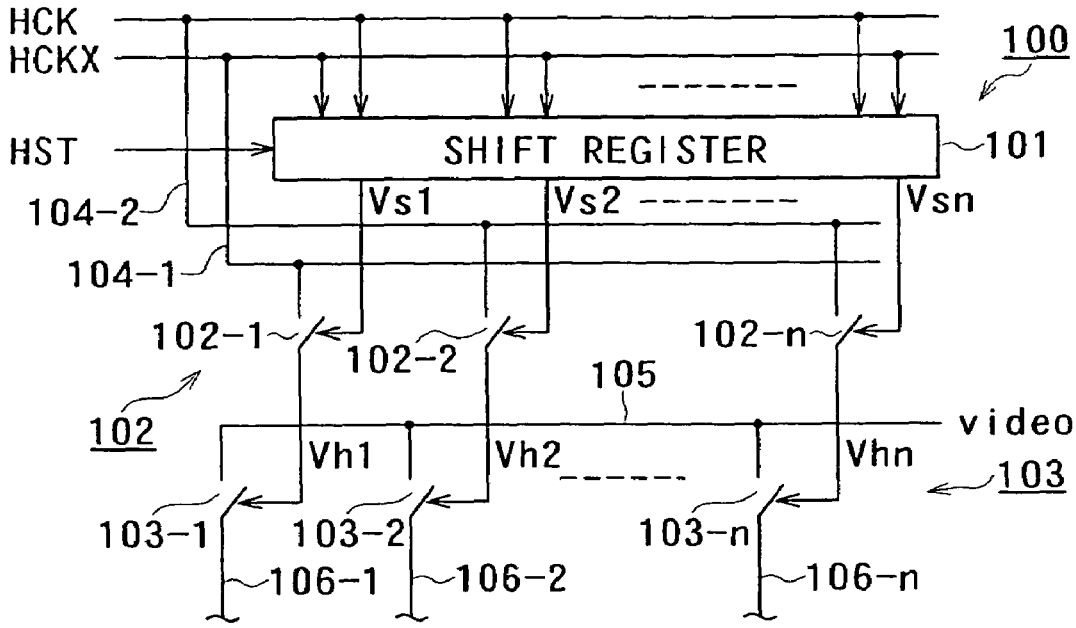
FIG. 13 is a block diagram showing a configuration of a clock driving type horizontal driving circuit according to a conventional example.
Figure 14:
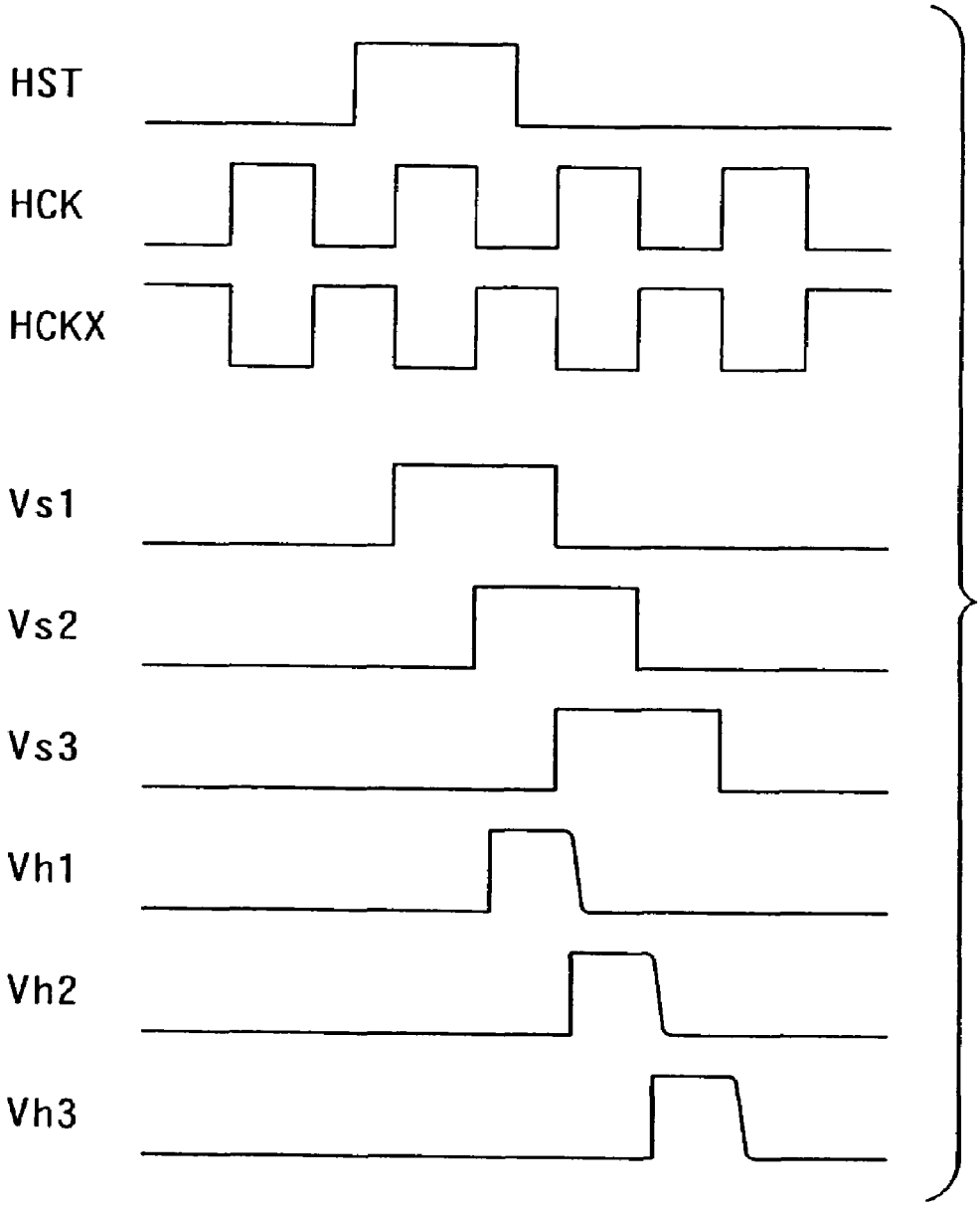
FIG. 14 is a timing chart of assistance in explaining operation of the clock driving type horizontal driving circuit according to the conventional example.
Figure 15:
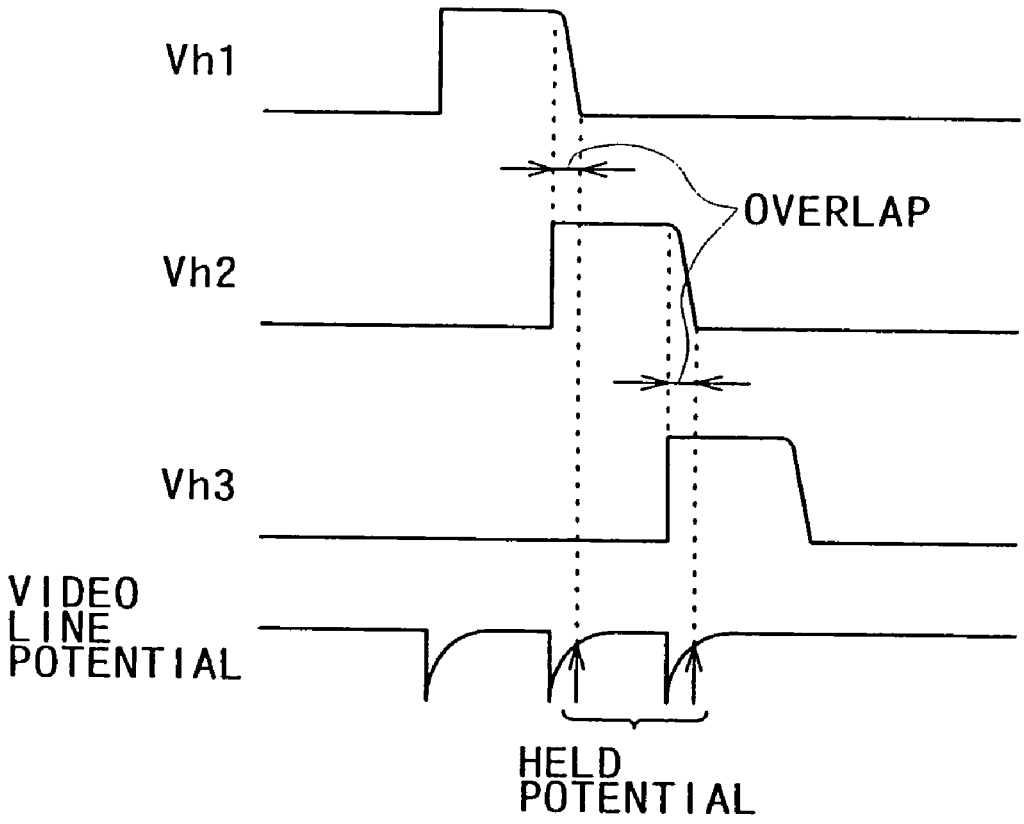
FIG. 15 is a timing chart of video signal sampling operation of the clock driving type horizontal driving circuit according to the conventional example.
Figure 16:
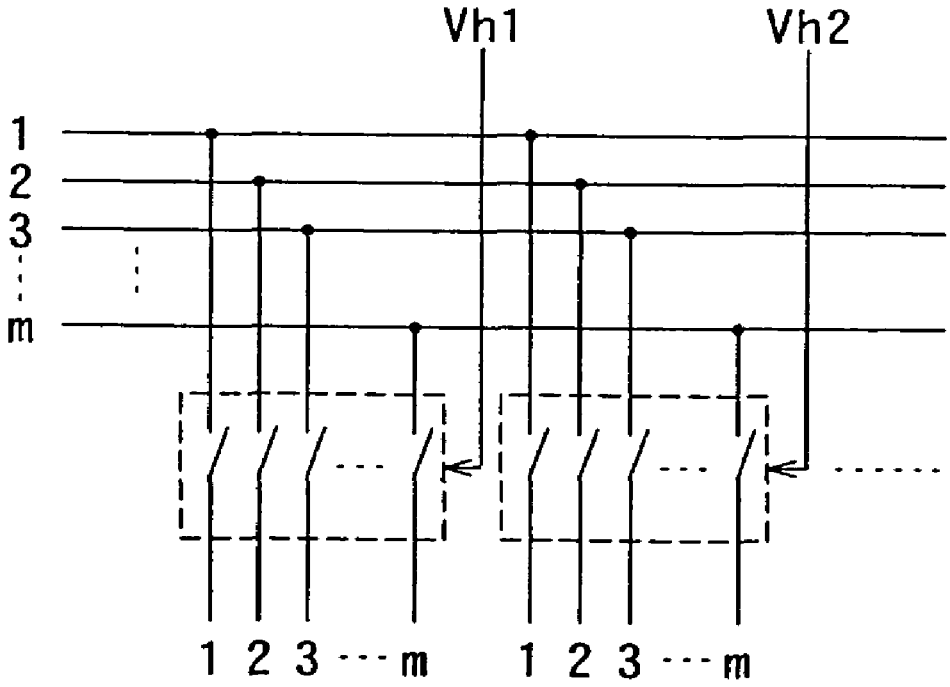
FIG. 16 is a diagram showing a configuration of a sampling switch group when video signals are inputted in parallel by "m" systems.
Figures 17A, 17B, 17C:
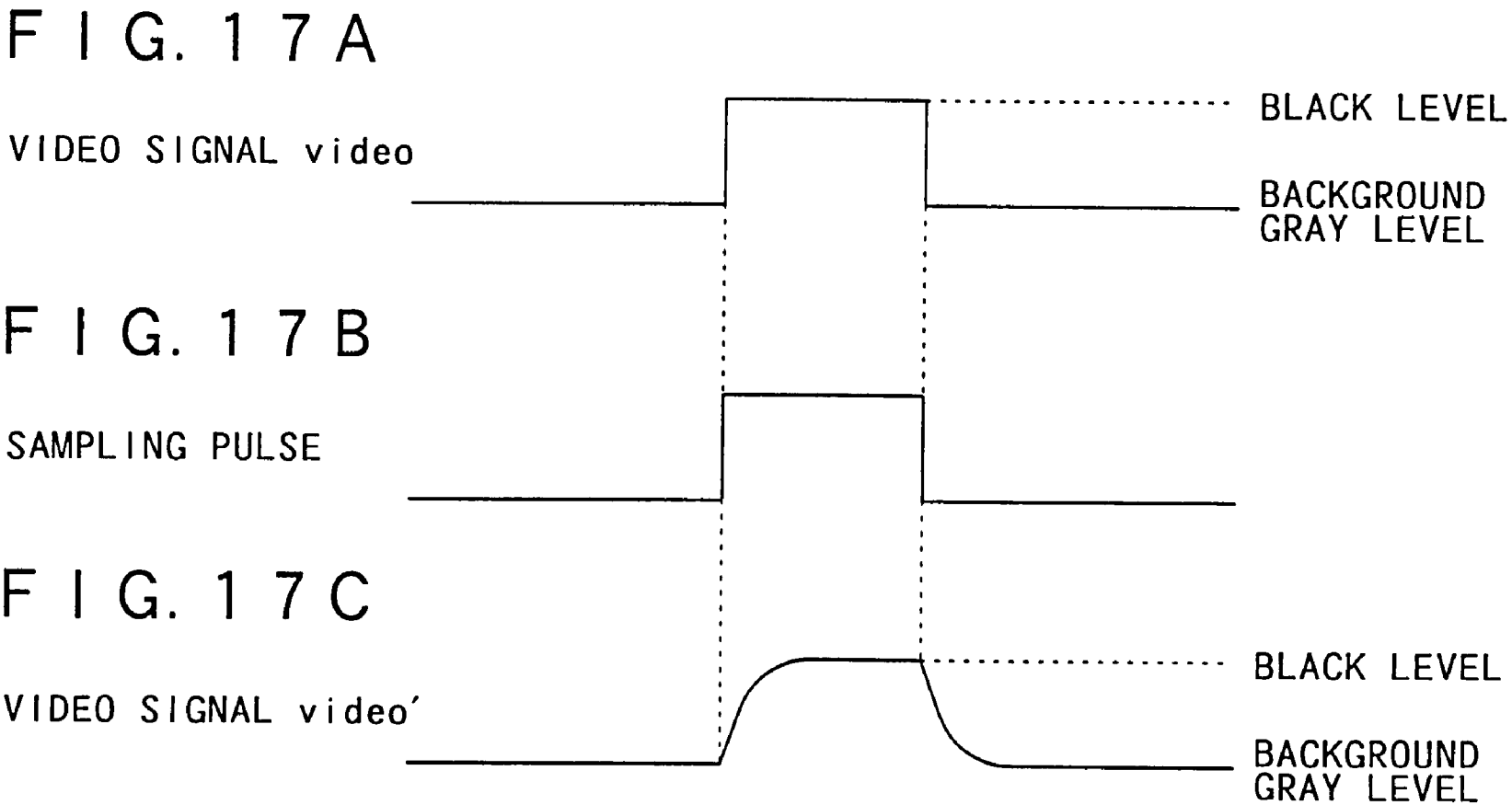
FIGS. 17A, 17B, and 17C are waveform charts showing a rounded state of a video signal in the form of a pulse.
Figure 18:
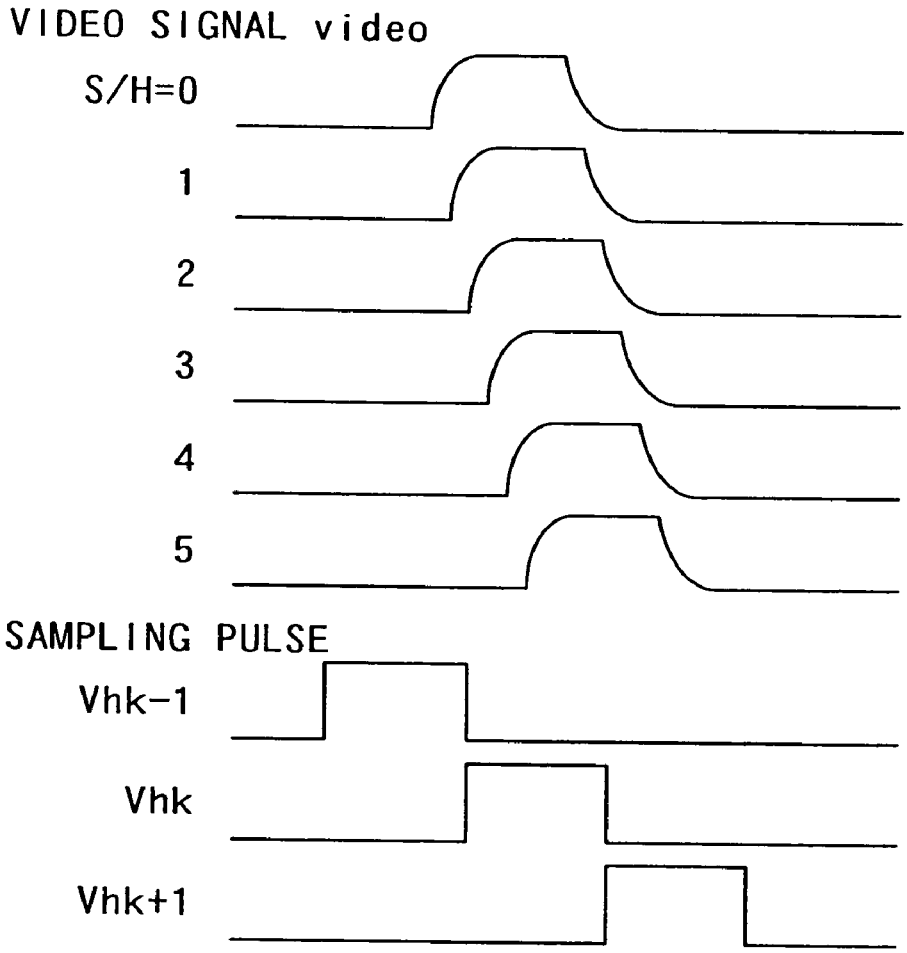
FIG. 18 is a timing chart showing a phase relation between a video signal "video" taking sample hold positions S/H=0 to 5 and overlapping sampling pulses Vhk−1, Vhk, and Vhk+1.
Figure 19:
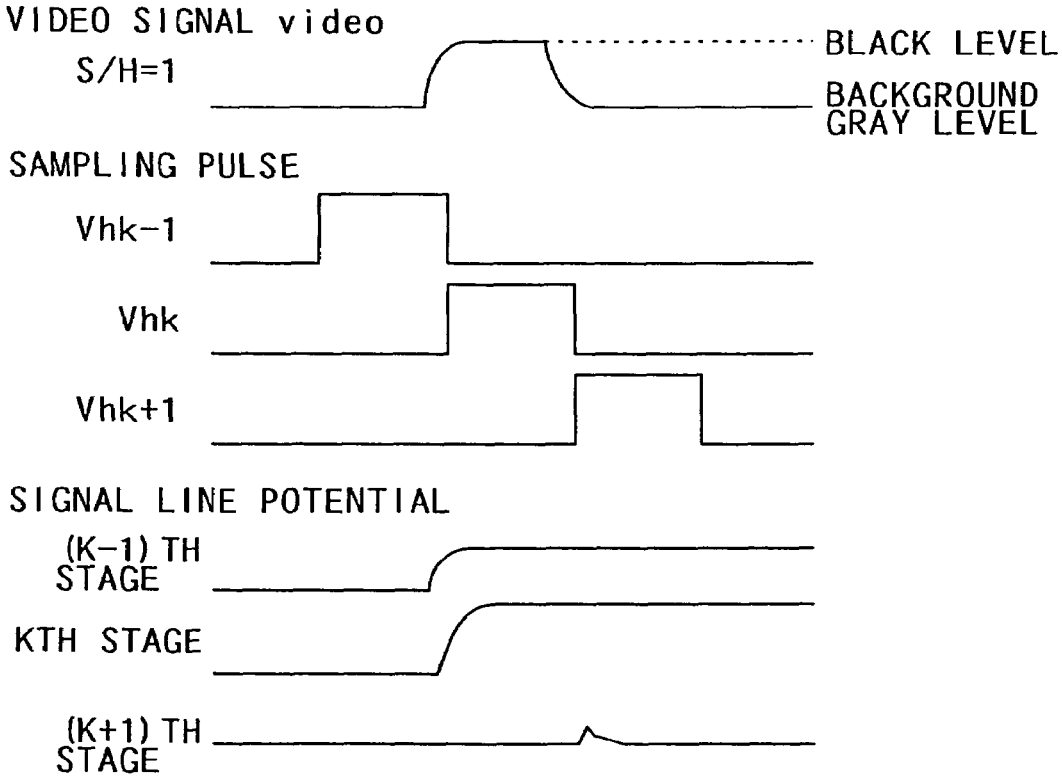
FIG. 19 is a timing chart showing a phase relation between the video signal "video" when S/H=1 and the overlapping sampling pulses Vhk−1, Vhk, and Vhk+1, and change in signal line potential.
Figure 20:
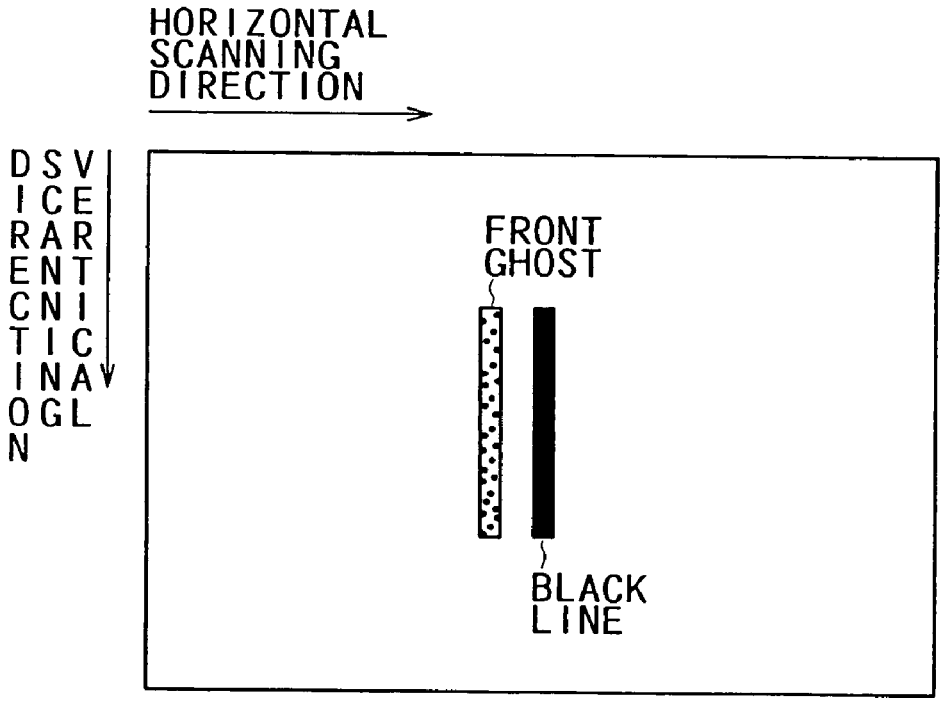
FIG. 20 is a diagram showing a ghost occurring in a front direction of horizontal scanning.
Figure 21:
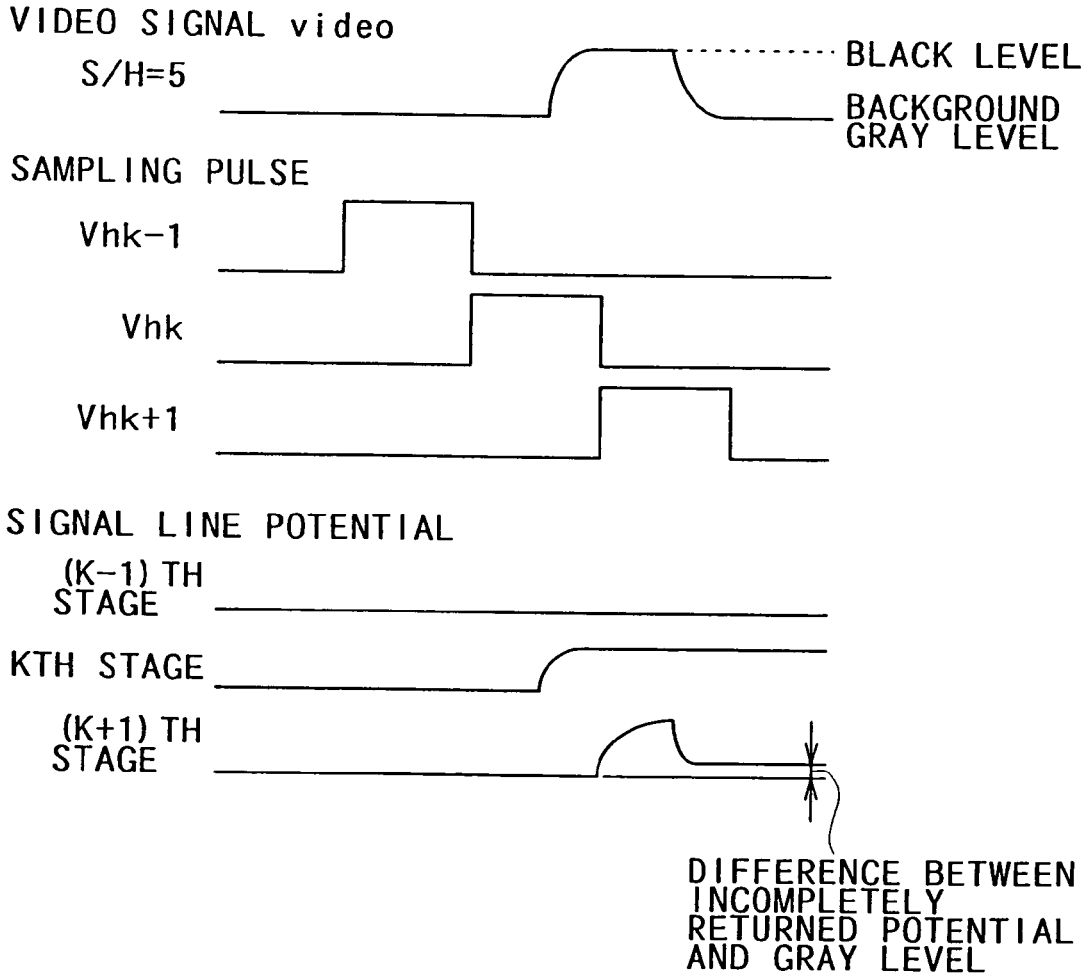
FIG. 21 is a timing chart showing a phase relation between the video signal "video" when S/H=5 and the overlapping sampling pulses Vhk−1, Vhk, and Vhk+1, and change in signal line potential.
Figure 22:
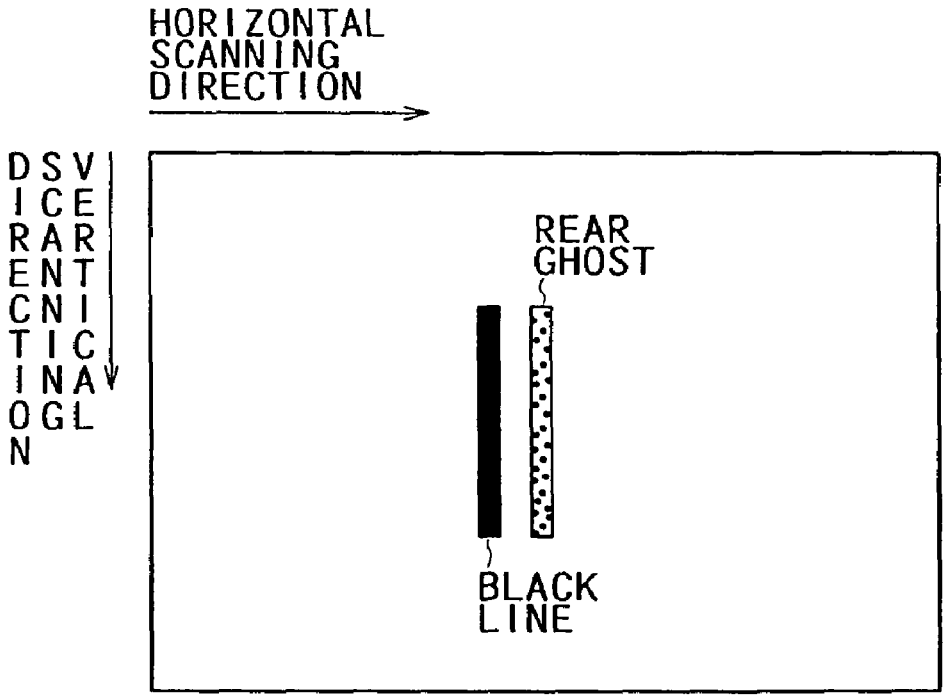
FIG. 22 is a diagram showing a ghost occurring in a rear direction of horizontal scanning.

FIG. 12 is a schematic block diagram showing a general configuration of a display apparatus according to the present invention. As shown in FIG. 12, the display apparatus includes a video signal source 31, a system board 32, and an LCD panel 33. In this system configuration, the system board 32 subjects a video signal outputted from the video signal source 31 to signal processing such as adjustment of the above-mentioned sample hold position. The system board 32 includes the external clock generating circuit 18 shown in FIG. 1 and FIG. 5. The active matrix liquid crystal panel of the dot-sequential driving type according to the embodiment shown in FIG. 1 and FIG. 5 is used as the LCD panel 33. As described above, the LCD panel 33 includes the internal clock generating circuit 19.

As described above, according to the present invention, in horizontal driving by the clock driving method, the active matrix display apparatus of the dot-sequential driving type generates a second clock signal having the same cycle as and having a lower duty ratio than a first clock signal serving as a basis for horizontal scanning, extracts the second clock signal, and samples a video signal using the second clock signal as a sampling pulse. The active matrix display apparatus can thereby realize perfect non-overlap sampling. Therefore, it is possible to prevent a vertical streak caused by overlap sampling and increase the ghost margin. In particular, according to the present invention, the first clock signal supplied externally is processed to internally generate the second clock signal. Thus, it is possible to prevent an increase in the numbers of terminals and wirings to be formed on the panel.

While a preferred embodiment of the invention has been described using specific terms, such description is for illustrative purposes only, and it is to be understood that changes and variations may be made without departing from the spirit or scope of the following claims.

What is claimed is:

1. A display apparatus comprising:

a panel having gate lines in a form of rows, signal lines in a form of columns, and pixels arranged in a matrix manner at intersections of the gate lines and the signal lines;

a vertical driving circuit connected to the gate lines for sequentially selecting a row of the pixels;

a horizontal driving circuit connected to the signal lines for operating on the basis of a clock signal having a predetermined cycle and sequentially writing a video signal to the pixels of the selected row; and first clock generating means for generating a first clock signal serving as a basis for the operation of the horizontal driving circuit, and second clock generating means for generating a second clock signal having a same cycle as, but having a lower duty ratio than, the first clock signal;

wherein a pulse width of the second clock signal is narrower than a pulse width of the first clock signal, and wherein said horizontal driving circuit comprises: a shift register for receiving said first clock signal and a start pulse and performing shift operation in synchronism with said first clock signal and sequentially outputting a shift pulse from each shift stage thereof; a first switch group for extracting a pulse to serve as a sampling pulse from said second clock signal in response to said shift pulse; and a second switch group for sequentially sampling the input video signal in response to said sampling pulse, and supplying the sampled video signal to each of the signal lines; and wherein said first clock generating means is disposed external to the panel and supplies the horizontal driving circuit with the first clock signal; and said second clock generating means is disposed within the panel and supplies the horizontal driving circuit with the second clock signal.

2. A display apparatus as claimed in claim 1, wherein said second clock generating circuit processes the first clock signal supplied from the first clock generating circuit and thereby generates the second clock signal.

3. A display apparatus as claimed in claim 2, wherein said second clock generating circuit comprises a delay circuit for subjecting the first clock signal to delaying processing, and generates the second clock signal using the first clock signal before the delaying processing and the first clock signal after the delaying processing.

4. A display apparatus as claimed in claim 3, wherein said delay circuit is formed by an even number of inverters connected in series with each other.

5. A display apparatus as claimed in claim 3, wherein said second clock generating circuit has a NAND circuit for generating the second clock signal by NAND synthesis of the first clock signal before the delaying processing and the first clock signal after the delaying processing.

* * * * *